US010299977B2

(12) United States Patent
Fakhrizadeh

(10) Patent No.: US 10,299,977 B2
(45) Date of Patent: May 28, 2019

(54) MULTI-FUNCTIONAL AND MULTIPOSITIONAL BED

(71) Applicant: Mohammad Fakhrizadeh, Saveh (IR)

(72) Inventor: Mohammad Fakhrizadeh, Saveh (IR)

( * ) Notice: Subject to any disclaimer, the term of this patent is extended or adjusted under 35 U.S.C. 154(b) by 287 days.

(21) Appl. No.: 15/221,792

(22) Filed: Jul. 28, 2016

(65) Prior Publication Data

US 2016/0331615 A1 Nov. 17, 2016

Related U.S. Application Data

(63) Continuation of application No. PCT/IB2015/055991, filed on Aug. 6, 2015.

(30) Foreign Application Priority Data

Aug. 7, 2014 (IR) ..... 139350140003005187

(51) Int. Cl.
*A61G 7/005* (2006.01)
*A61G 7/057* (2006.01)
(Continued)

(52) U.S. Cl.
CPC ..... *A61G 7/0573* (2013.01); *A61G 7/005* (2013.01); *A61G 7/008* (2013.01); *A61G 7/012* (2013.01); *A61G 7/015* (2013.01); *A61G 7/018* (2013.01); *A61G 7/0503* (2013.01); *A61G 7/057* (2013.01); *A61G 7/0507* (2013.01); *A61G 7/0509* (2016.11); *A61G 7/0515* (2016.11); *A61G 7/07* (2013.01); *A61G 7/072* (2013.01); *A61G 7/0755* (2013.01); *A61G 7/1044* (2013.01); *A61G 7/1059* (2013.01); *A61G 7/16* (2013.01); *A61G 7/165* (2016.11); *A61G 2200/32* (2013.01); *A61G 2200/36* (2013.01); *A61G 2203/10* (2013.01)

(58) Field of Classification Search
CPC ..... A61G 7/005; A61G 13/04
USPC ..... 5/607–611
See application file for complete search history.

(56) References Cited

U.S. PATENT DOCUMENTS 211,741 A 1/1879 Johnson
1,404,482 A 1/1922 Sawyer
(Continued)

FOREIGN PATENT DOCUMENTS

DE 20206840 U1 8/2002
DE 102012005760 A1 9/2013

OTHER PUBLICATIONS

PCT/IB2015/055991—Written Opinion.

*Primary Examiner* — Fredrick C Conley
(74) *Attorney, Agent, or Firm* — NovoTechIP International PLLC

(57) ABSTRACT

A bed includes a telescoping foot-end leg at a first end; a telescoping head-end leg at a second end opposite from the first end; a rotating frame that rotates on a lateral first axis extending between an upper portion of the foot-end leg and an upper portion of the head-end leg; and a tilting frame supported by the rotating frame. The rotating frame tilts on a second axis perpendicular to the first axis. The tilting frame is configured to support the patient's entire body. The foot-end leg and the head-end leg are configured to be telescoped while the patient is on the bed such that the height of the foot-end leg is lower than the height of the head-end leg and a slope of the first axis is at least 15 degrees.

17 Claims, 19 Drawing Sheets

(51) Int. Cl.

| | |
|---|---|
| ***A61G 7/008*** | (2006.01) |
| ***A61G 7/015*** | (2006.01) |
| ***A61G 7/07*** | (2006.01) |
| ***A61G 7/075*** | (2006.01) |
| ***A61G 7/05*** | (2006.01) |
| ***A61G 7/012*** | (2006.01) |
| ***A61G 7/018*** | (2006.01) |
| ***A61G 7/10*** | (2006.01) |
| ***A61G 7/16*** | (2006.01) |

(56) References Cited

U.S. PATENT DOCUMENTS

| | | | | |
|---|---|---|---|---|
| 2,339,075 | A | 1/1944 | Hollnagel | |
| 2,540,133 | A | 2/1951 | Miller | |
| 2,761,152 | A | 9/1956 | Pirone | |
| 3,013,281 | A | 12/1961 | Steiner | |
| 3,239,853 | A | 3/1966 | Macdonald | |
| 3,434,165 | A | 3/1969 | Keane | |
| 3,611,453 | A | 10/1971 | Lokken | |
| 3,722,010 | A | 3/1973 | Satemus | |
| 3,743,905 | A | 7/1973 | Goodman | |
| 4,085,472 | A | 4/1978 | DiMatteo | |
| 4,356,577 | A | 11/1982 | Taylor | |
| 4,654,903 | A | 4/1987 | Chubb | |
| 4,989,280 | A | 2/1991 | Balr | |
| 5,095,561 | A | 3/1992 | Green | |
| 5,345,629 | A | 9/1994 | Ferrand | |
| 5,355,540 | A | 10/1994 | Allen | |
| 5,430,901 | A | 7/1995 | Farley | |
| 5,535,464 | A | 7/1996 | Salonlca | |
| 5,542,138 | A | 8/1996 | Williams | |
| 5,594,965 | A | 1/1997 | Vanzant | |
| 5,806,114 | A | 8/1998 | Morgan | |
| 6,209,158 | B1 | 4/2001 | Cox | |
| 6,694,557 | B1 | 2/2004 | Bobey | |
| 7,086,103 | B2 | 8/2006 | Barthelt | |
| 7,296,312 | B2 | 11/2007 | Menkedick | |
| 7,346,945 | B2 | 3/2008 | Phillips | |
| 7,426,760 | B2 | 9/2008 | Vrzallk | |
| 7,520,006 | B2 | 4/2009 | Menkedick | |
| 7,533,429 | B2 | 5/2009 | Menkedick | |
| 7,610,637 | B2 | 11/2009 | Menkedick | |
| 7,914,611 | B2 | 3/2011 | Vrzalik | |
| RE43,155 | E | 2/2012 | Allen | |
| 8,122,545 | B2 | 2/2012 | Wilkinson | |
| RE43,532 | E | 7/2012 | Menkedick | |
| 2006/0185090 | A1* | 8/2006 | Jackson | A61G 7/001 5/621 |

* cited by examiner

MULTI-FUNCTIONAL AND MULTIPOSITIONAL BED

CROSS REFERENCE TO RELATED APPLICATION

This application is a continuation of PCT/IB2015/055991 filed Aug. 6, 2016, which claims the benefit of priority to an Iran patent application having serial number 13935014003005187 filed on Aug. 7, 2014, which subsequently issued as Iran Patent No. 16 84117 on Oct. 28, 2014, all of which are incorporated by reference herein in their entireties.

BACKGROUND

There are many patients which, for various reasons, require extended periods of bedrest, such as, but not limited to, patients with movement disabilities, spinal cord injuries, or who have suffered strokes. A number of complications arise from patient inactivity, such as bedsores, urinary tract infections, shortening or weakening of muscles, abnormal muscle stiffness, osteoporosis, impaired blood flow, and impaired respiratory activity. Also, difficulty in moving patients that are unable to move themselves is difficult for caregivers, as not all possible caregivers have the necessary strength, and among those who do, there remains a substantial risk of injury to caregivers and patients when executing such movements.

Some people lose their motor power because of accidents or diseases. This may affect their mental or corporal systems, so they have problems in their usual lives. If one thinks he is a burden for others, this may diminish his interest for continuance of life. To prevent these disorders, many devices were designed to facilitate motor needs of disabled persons. Usage of these devices not only promotes life quality but also increases life hope for disabled persons and their families.

There are many medical devices to aid disabled persons to diminish their problems and impairments. For example, there are wavy mats and rotating beds that may prevent bed ulcers. Also there are types of tilt tables and orthopedic tables. However, these devices have limited efficiency and do not cover some patient needs. For example, bed ulcers are a significant disorder, and may appear only after 4 days if appropriate steps are not taken. Some influential factors in causing bedsores are pressure, humidity, and the existence of bacteria and fungi. The usage of the wavy mattresses is for the prevention of the bedsores. However, the wavy mattresses in addition to their primary high cost impose great expenses for their maintenance and repair. On the other hand, those mattresses are only effective on the pressure factor and are not able to eliminate the other influential factors.

The usage of rotating beds has a positive effect to some degree but also lacks the ability to remove all the factors.

One of the first invisible effects of movement disability is the excretion of calcium through urine. Naturally, if a person stays in bed for three days without standing during this period, the amount of calcium discharger through urine increases by 46% and if this period lasts for two weeks, it could increase up to 83%. Excess discharge of calcium may result in osteoporosis, urinary infections, or other urinary tract complications. Nowadays, for decreasing such symptoms, tilt tables or other equipment which facilitate standing are used. However, to utilize such equipment, the patient must be moved from the bed to the equipment. Such movement cannot be done by normal individuals and require strong nurses, the lack of whom is evident worldwide. Therefore, such equipment can only be used with difficulty in the professional clinics. Hence, such transfer (from home to clinic) and performing the required operations is not only costly but also there is a great chance of harming the person with disability or the person performing the operation. In fact, many of nurses suffer serious injuries while performing such operations. Thus, disabled individuals who are unable to move generally do not enjoy the medical advantages of standing. More examples could be given regarding the weakness of existing equipment.

As indicated before, existing devices have specific and limited usage which could facilitate the partial movement of disabled patients to some extent and decrease some dependencies but could not provide for all their essential needs.

In most cases, complications arising from movement disabilities can spiral out of control. Hitherto, prevention or treatment of the complications arising from movement disabilities has been a rather difficult task, and has been beyond many people's capacities as it imposes great expenses on them, their families, and even society.

In order to prevent and control such symptoms, the necessity for equipment which could better serve the needs of disabled individuals, is felt more and more. In addition to significantly upgrading quality of life for patients and their and their families, such equipment can also increase patient life expectancy.

SUMMARY

The foregoing and other objects, features, aspects and advantages of the present invention will become more apparent from the following detailed description of the present application when taken in conjunction with the accompanying drawing.

In one general aspect, the instant application describes a bed for a patient to lie upon, the bed including a telescoping foot-end leg at a first end of the bed; a telescoping head-end leg at a second end of the bed opposite from the first end; a rotating frame which rotates on a lateral first axis extending between an upper portion of the foot-end leg and an upper portion of the head-end leg; and a tilting frame supported by the rotating frame which tilts on a second axis perpendicular to the first axis, wherein the tilting frame is configured to support the patient's entire body while the patient is lying on the bed; wherein the foot-end leg and the head-end leg are capable of being telescoped while the patient is on the bed such that the height of the foot-end leg is lower than the height of the head-end leg and a slope of the first axis is at least 15 degrees; wherein the foot-end leg and the head-end leg are capable of being telescoped while the patient is on the bed such that the height of the foot-end leg is greater than the height of the head-end leg and a slope of the first axis is at least 15 degrees; wherein the rotating frame is capable of being rotated at least 30 degrees on the first axis in both a clockwise and counterclockwise direction from a flat position while the patient is lying on the bed; and wherein the tilting frame is capable of being tilted on the second axis by at least 60 degrees while the patient is on the bed.

The rotating frame may be capable of being rotated 45 degrees on the first axis in both a clockwise and counterclockwise direction from a flat position while the patient is lying on the bed; and the tilting frame may be capable of being tilted on the second axis by 85 degrees while the patient is on the bed.

The bed may further include a lower leg plate configured to support the patient's lower legs while the patient is lying on the bed; a turning arm which supports the lower leg plate, is supported by the tilting frame, and is configured to rotate both upward and downward around a third axis parallel to the second axis and near the middle portion of the tilting frame; a locking system configured to lock the lower leg plate and the turning arm together on demand; and a pivot attaching the lower leg plate to the turning arm and allowing the lower leg plate to translate rotationally around a fourth axis parallel to the second axis and passing through the pivot, wherein the fourth axis is different from the third axis; wherein when the lower leg plate is positioned within and parallel to the tilting frame, the lower leg plate extends from a toe-end area of the tilting frame to a middle area of the tilting frame; wherein the lower leg plate is capable of translating rotationally, both upward and downward from a horizontal position when the locking system is active, around a third axis parallel to the second axis and near the middle portion of the tilting frame; and wherein the lower leg plate comprises a plurality of receptacles configured to accept one or more accessories.

The lower leg plate may be configured to be positioned above and substantially parallel to the tilting frame while turning arm is rotated upward, when the locking system is released.

The bed may further include a torso plate supported by the tilting frame and configured to support the patient's upper body while the patient is lying on the bed; wherein when the torso plate is substantially parallel to the tilting frame, the torso plate extends from a head-end area of the tilting frame to a head-end area of the rotating frame; and wherein the torso plate is capable of translating rotationally about a third axis parallel to the second axis and near the head-end area of the tilting frame.

The bed may further include a torso frame which supports the torso plate, is supported by the tilting frame, and is configured to rotate upward around the third axis; wherein the torso plate is configured to slide linearly along the torso frame away from the tilting frame while the torso frame is being rotated upwards.

The third axis may be capable of moving laterally toward the head end of the bed while the torso frame is being rotated upward.

The third axis may be capable of moving laterally while the torso plate is maintained substantially parallel to the tilting frame.

The torso plate may be further configured to translate rotationally about a fourth axis parallel to the second axis and near the head-end area of the rotating frame.

The bed may further include a torso frame supported by the tilting frame and configured to support the patient's upper body while the patient is lying on the bed; wherein when the torso frame and the tilting frame are both in horizontal positions, the torso plate extends from a head-end area of the tilting frame to a head-end area of the rotating frame; and wherein the torso plate is capable of translating rotationally about a fourth axis parallel to the second axis and near the head-end area of the tilting frame.

The bed may further include a first motor for translating the lower leg plate rotationally; a second motor for translating the torso plate rotationally; and a controller configured to operate the first and second motors at a first speed while in a program mode, and further configured to operate the first and second motors at a second speed greater than the first speed in response to manual commands.

The bed may further include a bridging support that connects the foot-end leg and the head-end leg, and is adjacent to the rotating frame; a jack which is pivotally coupled to the bridging support and which can be rotated from a horizontal position to a vertical position; and at least two receptacles configured to accept accessories; wherein when the jack is in the vertical position, it is configured to prevent a patient from tipping off of the bed while being transferred in or out of the bed using a portable patient lift attached to the bed.

The foot-end leg may include a first wheel on a left side of the foot-end leg and a second wheel on a right side of the foot-end leg, the first and second wheels each having an axis of rotation approximately perpendicular to the first axis; and the foot-end leg may further include a third wheel having an axis of rotation approximately parallel to the first axis which may be selectively moved between a raised and lowered position, wherein when the third wheel is in the lowered position the foot-end leg is supported by the third wheel and when the third wheel is in the raised position the foot-end leg is supported by the first and second wheels.

The bed may further include a mattress configured to be positioned under the patient's hips while the patient is lying on the bed; and a portable seat configured to be positioned under the mattress while the patient is lying on the bed; wherein the portable seat includes belt attachments which allow the patient, the mattress, and the portable seat to be transferred in and out of the bed by use of a portable patient lift attached to the bed while the patient is seated on the mattress.

The bed my further include a removable knee pad configured to be attached to the bed while positioned between the patient's knees; a first lower shield railing rotatably supported by a right side of the rotating frame; a second lower shield railing rotatably supported by a left side of the rotating frame; a first upper shield railing rotatably supported by the first lower shield railing; and a second upper shield railing rotatably supported by the first lower shield railing; wherein each of the first and second lower shield railings is configured to be fixed in at least two positions relative to the rotating frame including a first position approximately parallel to the rotating frame, and a second position rotated upward and approximately perpendicular to the rotating frame; and wherein each of the first and second upper shield railings is configured to be fixed in at least three positions relative to its respective lower shield railing including a third position downward from and substantially perpendicular to its respective lower shield railing, a fourth position substantially parallel to its respective lower shield railing, and a fifth position oriented in toward to rotating frame.

The bed my further include a hinge plate coupled to a first side of the first lower shield railing; a step attached to a second side of the first lower shield railing; a pin configured to controllably move in each side of the first upper shield railing; and a safety lever configured to secure the first upper shield railing when it is fixed in the fifth position.

BRIEF DESCRIPTION OF THE DRAWINGS

The drawing figures depict one or more implementations in accord with the present teachings, by way of example only, not by way of limitation.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 1:
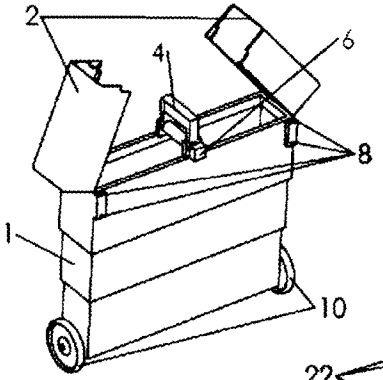
FIG. 1 illustrates an example of a foot-end leg 1 of the bed.

FIG. 1 illustrates an example of a foot-end leg 1 of a multi-functional and multi-positional bed. The height of foot-end leg 1 can be increased or decreased telescopically. In some examples, changes in height of foot-end leg 1 are performed by an electric motor (not illustrated), and a maximum height and/or a minimum height are detected by one or more limit switches (not illustrated). In some examples, the limit switches may be implemented by simple electromechanical switches at the end of a range of travel. In some examples, the limit switches may be implemented by software in response to detected changes in height. In FIG. 1, foot-end leg 1 is telescoped to its maximum height. At the top of foot-end leg 1, foot-end leg 1 includes a bearing 4 which holds and permits axial rotation of base 6. In addition, at the top of foot-end leg 1 are doors 2 through which the inner parts of foot-end leg 1 can be accessed for assembly, maintenance, and repair. Also, there are four holes 8 on an interior side of foot-end leg 1. At the lower end of foot-end leg 1 are included two wheels 10 attached to foot-end leg 1 via a shaft set in a direction perpendicular to the axis of bearing 4 to make axial movement and at least one other function of the bed possible.

Figure 2:
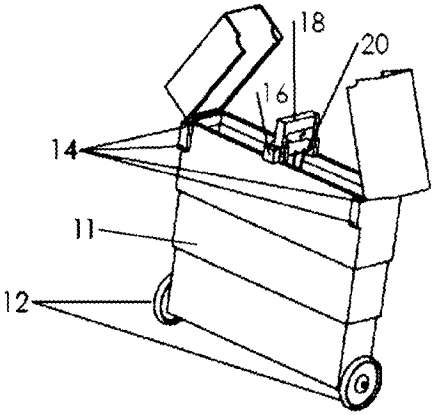
FIG. 2 illustrates an example of a head-end leg 11 of the bed.

FIG. 2 illustrates an example of a head-end leg 11 of the bed. In much the same manner as foot-end leg 1, the height of head-end leg 11 can be increased or decreased telescopically. In some examples, changes in height of head-end leg 11 are performed by an electric motor (not illustrated), and a maximum height and/or a minimum height are detected by one or more limit switches (not illustrated). In some examples, the limit switches may be implemented by simple electromechanical switches at the end of a range of travel. In some examples, the limit switches may be implemented by software in response to detected changes in height. In FIG. 1, foot-end leg 1 is telescoped to its maximum height. In FIG. 2, head-end leg 11 is telescoped to its maximum height. At the top of head-end leg 11, head-end leg 11 includes a bearing 18 which holds and permits axial rotation of base 16. This rotation can be performed using lever 20. Also, there are four holes 14 on an interior side of head-end leg 11. At the lower level of head-end leg 11, there are two wheels 12 which rotate in the same direction of wheels 10 and attached to head-end leg 11 via a shaft set in a direction perpendicular to the axis of bearing 18 to make axial movement and at least one other function of the bed possible.

Figure 3:
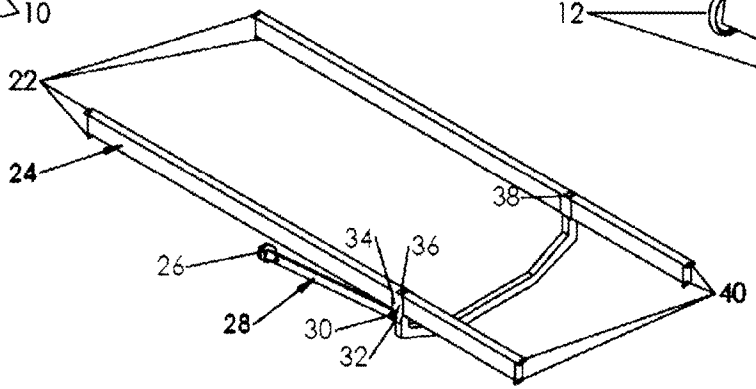
FIG. 3 illustrates an example of a bridging support 24 which connects foot-end leg 1 and head-end leg 11.

FIG. 3 illustrates an example of a bridging support 24 which connects foot-end leg 1 and head-end leg 11. At a left end of bridging support 24 (as illustrated in FIG. 3) are four holes 22 arranged to be linked with holes 8 of foot-end leg 1 using screws, bolts, or other fasteners. At a right end of bridging support 24 (as illustrated in FIG. 3) are four holes 40 arranged to be linked with holes 14 of head-end leg 11 using screws, bolts, or other fasteners. On the top side of bridging support 24 are at least two receptacles 36 and 38 for receiving accessories such as a portable patient lift for transferring a patient from wheelchair to the bed and vice versa.

Bridging support 24 also includes base plate 34 to which jack 28 is pivotally coupled using pin 30. Jack 28 includes adjustable base 26 to compensate for possible floor corrugations or any other reasons. Base plate 34 has a stopper 32 and after the jack 28 is activated after manually turned counterclockwise and crossing the vertical line would collide with the stopper 32 and stops, thereby preventing tipping off of the bed when a patient is being transferred in or out of the bed using a portable patient lift.

Figure 7:
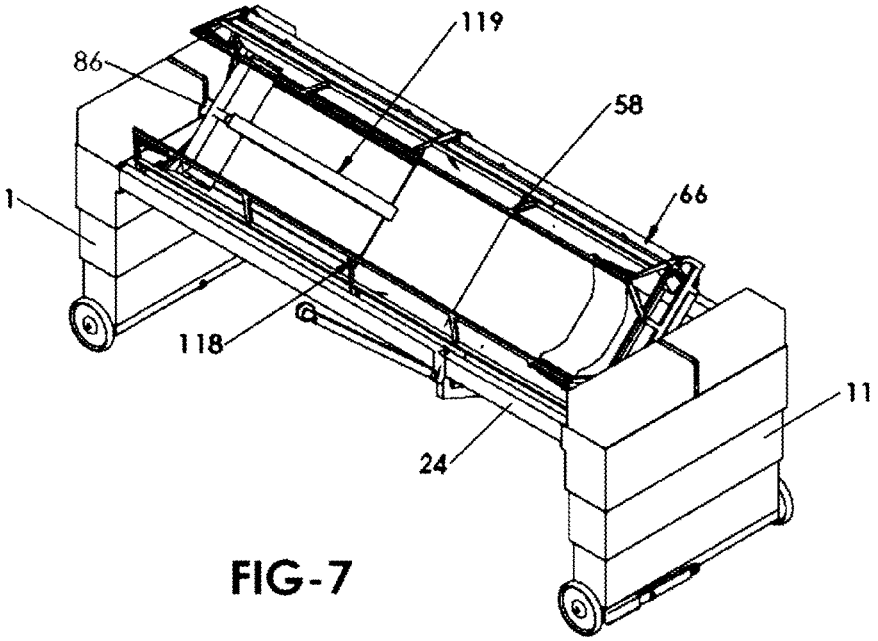
FIG. 7 illustrates an example in which the features illustrated in FIGS. 1-3 and 6 have been connected together, and rotating frame 88 has been rotated to the patient's left.

By connecting the components illustrated in FIGS. 1-3, much as illustrated in FIG. 7, a four-wheeler framework is provided for attaching the other components of the bed discussed in this disclosure.

Figure 4:
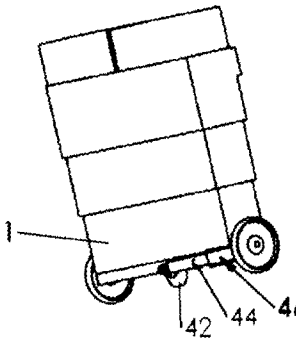
FIG. 4 illustrates an example of a wheel 42 for foot-end leg 1 that is not positioned in the same direction as wheels 10.
Figure 5:
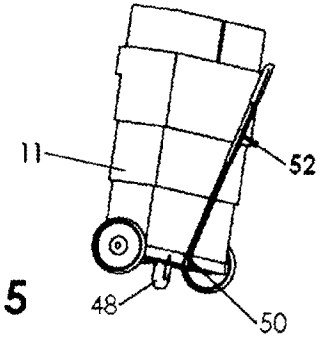
FIG. 5 illustrates an example of a wheel 48 for head-end leg 11 that is not positioned in the same direction as wheels 12.

FIG. 4 illustrates an example of a wheel 42 for foot-end leg 1 that is not positioned in the same direction as wheels 10. For example, an axis of wheel 42 may be approximately parallel to the axis of bearing 4. Wheel 42 is normally off the floor, and is configured to be manually activated by a telescopic lever 44, illustrated in a retracted mode, to facilitate the repositioning of foot-end leg 1 to a desired place by raising wheels 10 off the floor. The axle of wheel 42 is a crank shaft pivotally coupled to proximal side of the lever 44 via a coupler, much as shown in FIG. 5. The lever 44 has at its distal end a handle 46.

FIG. 5 illustrates an example of a wheel 48 for head-end leg 11 that is not positioned in the same direction as wheels 12. For example, an axis of wheel 48 may be approximately parallel to the axis of bearing 18. Wheel 48 is normally off the floor, and is configured to be manually activated by a telescopic lever 52, illustrated in an erected mode, to facilitate the repositioning of head-end leg 11 to a desired place by raising wheels 12 off the floor. The axle of wheel 48 is a crank shaft pivotally coupled to proximal side of the lever 52 via a coupler 50. The lever 52 has at its distal end a handle, much as shown in FIG. 4. Wheels 42 and 48 should be activated only one at a time to convert the four-wheeler framework to a tri-wheeler for maximum maneuverability of the bed.

The heights of foot-end leg 1 and head-end leg 11 can be individually adjusted. In some examples, foot-end leg 1 and head-end leg 11 can each be adjusted to have the top of bridging support 24 at a height of 45 to 85 cm from the floor. If the head-end leg 11 is raised to a higher altitude than foot-end leg 1, for example where the slope of bridging support 24 is 15 degrees or more, or even 18 degrees or more, the bed can be placed in a "reverse Trendelenburg" position in medical terms. If this position is reversed, where the foot-end leg 1 is raised to a higher altitude than head-end leg 11, for example where the slope of bridging support 24 is 15 degrees of more, or even 18 degrees or more, the bed can be placed in a "Trendelenburg" position in medical terms. In a level position, where the altitudes of foot-end leg 1 and head-end leg 11 are approximately the same, an adjustable "home position" is electronically designated to a level from the floor according to a patient need and at that point the bed could be considered in a "home" position, although the bed may be configured to recognize other positions.

Figure 6:
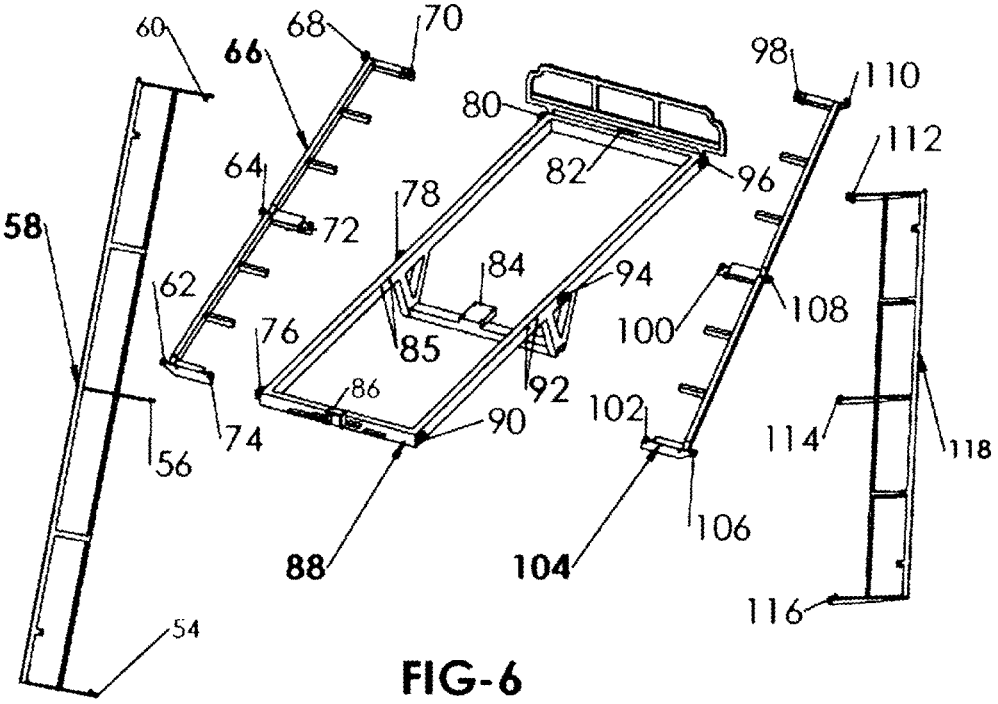
FIG. 6 illustrates an example of rotating frame 88 and related components of the bed.
Figure 10:
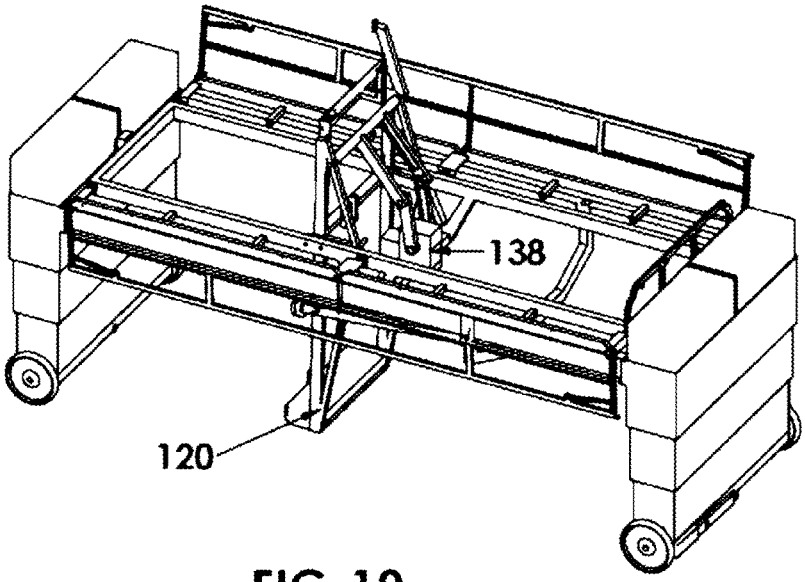
FIG. 10 illustrates an example in which the features of FIGS. 1-3, 6, 8, and 9 have been connected together, and tilting frame 120 has been tilted up into a vertical angle by actuator 138.
Figure 35:
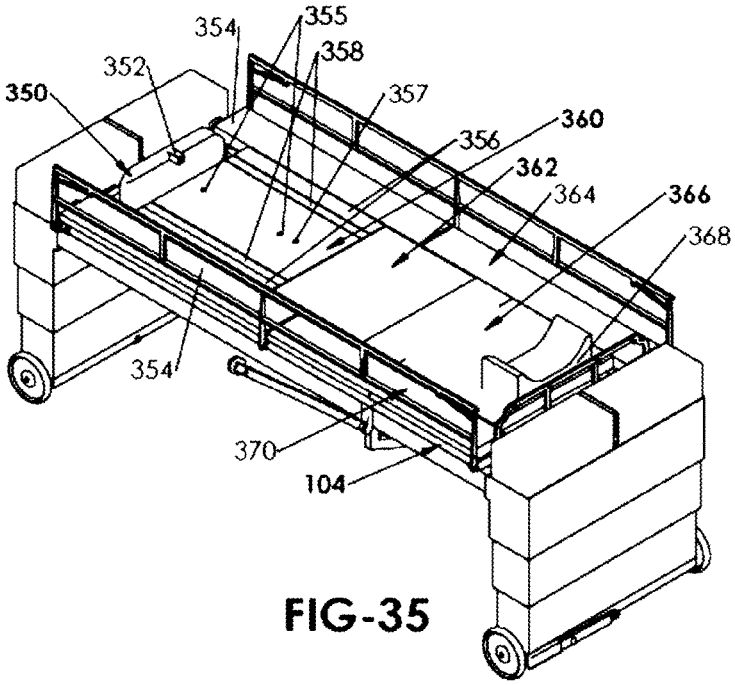
FIG. 35 illustrates an example of the placement of various mattresses on the bed.
Figure 42:
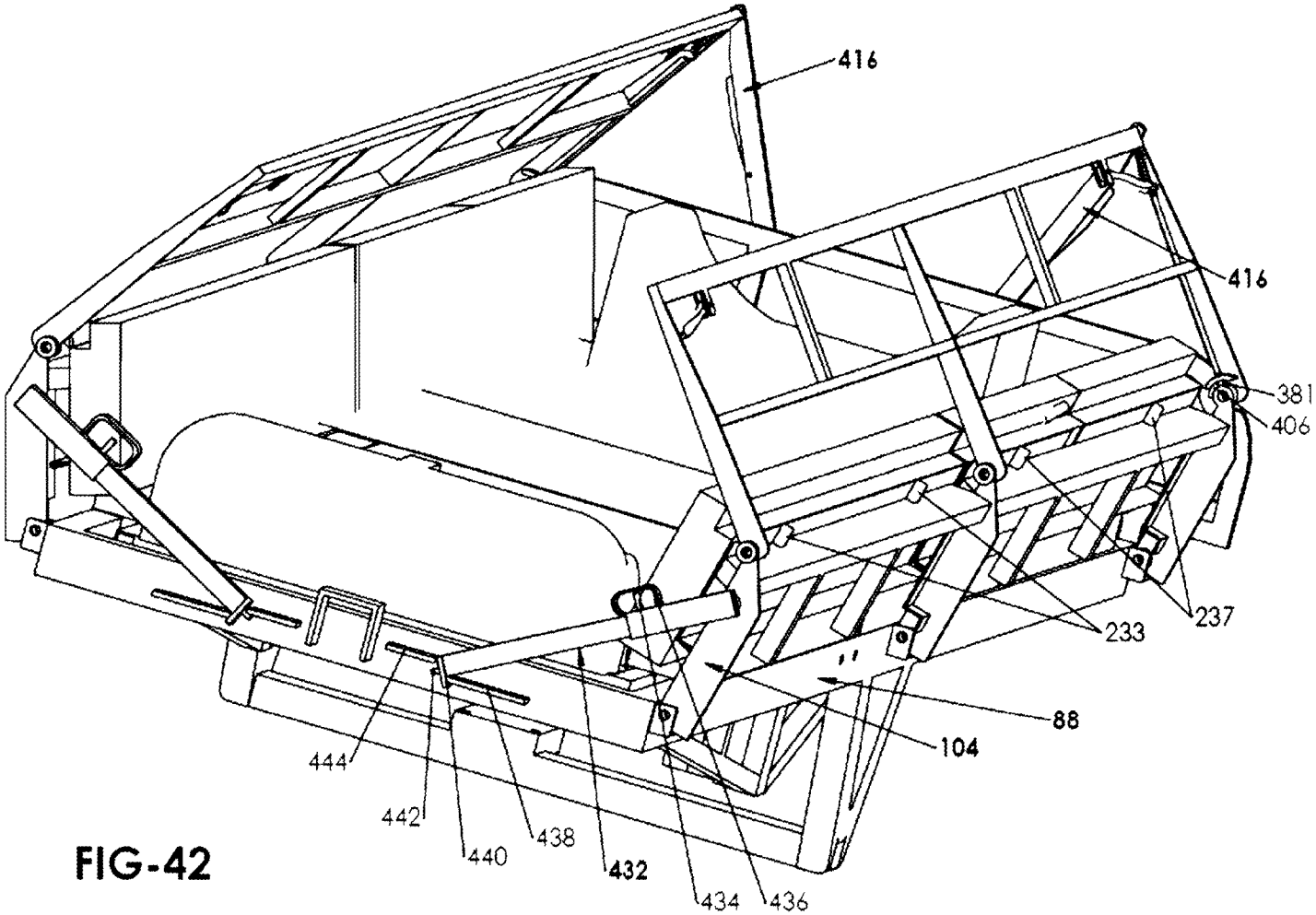
FIG. 42 illustrates an example in which upper shield railings 58 and 118 are each secured for rotation of rotating frame 88 using head safety levers 416 and leg safety lever 432.

FIG. 6 illustrates an example of rotating frame 88 and related components of the bed. Rotating frame 88 adjustably rotates about a lateral axis extending between bases 6 and 16 on bearings 4 and 18, as illustrated in FIG. 7, and comprises at least one limit switch (not illustrated) configured to be adjustable for a desired or needed angle from zero to at least 45 degrees whereby preventing a rotation that exceeds a predetermined angle. In some examples, the limit switch may be implemented by a simple electromechanical switch at the end of a range of travel. In some examples, the limit switch may be implemented by software in response to detected changes in angle or position. In some examples, rotation of rotating frame 88 can be performed in both the left and right directions by up to at least 30 degrees from a flat "home" position. In some examples, rotation of rotating frame 88 can be performed in both the left and right directions by up to approximately 45 degrees from a flat "home" position. On a left side (as illustrated in FIG. 6), rotating frame 88 includes hinge bases 76, 78 and 80 which are paired with respective hinges 74, 72 and 70 of lower shield railing 66. Lower shield railing 66 may be positioned horizontally as illustrated in FIG. 10; in this position it may serve as a base for the patient's bedding. Lower shield railing 66 may also be rotated up from the horizontal position to become part of a shield that restrains a patient when rotating frame 88 is rotated, as illustrated in FIGS. 7 and 42. Lower shield railing 66 includes hinge bases 62, 64, and 68 which are paired with respective hinges 54, 56, and 60 of upper shield railing 58. FIGS. 7, 10, and 35 illustrate various positions of upper shield railing 58 with respect to lower shield railing 66. For example, upper shield railing 58 may be folded inward along with inner shield railing 66 to become part of the shield mentioned above that restrains a patient when rotating frame 88 is rotated, as illustrated in FIGS. 7 and 42. As another example, upper shield railing 58 may be folded down to facilitate patient ingress and egress, as illustrated in FIG. 10. As another example, upper shield railing 58 may be folded up to keep a patent and their belongings in the bed, as illustrated in FIG. 35.

Figure 41:
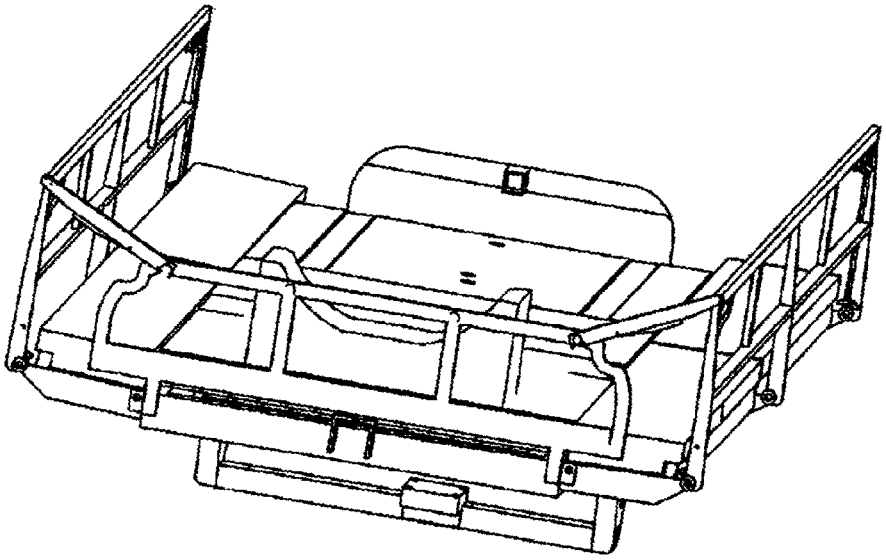
FIG. 41 illustrates an example in which upper shield railings 58 and 118 are each secured in their "normal" positions using head safety levers 416.

On a right side (as illustrated in FIG. 6), rotating frame 88 includes hinge bases 90, 94 and 96 which are paired with respective hinges 102, 100 and 98 of lower shield railing 104. As with lower shield railing 66, lower shield railing 104 may be positioned horizontally as illustrated in FIG. 10; in this position it serves as a base for the patient's bedding. Shield railing 104 may also be rotated up from the horizontal position to become part of a shield that restrains a patient when rotating frame 88 is rotated, as illustrated in FIGS. 7 and 42. Lower shield railing 104 includes hinge bases 106, 108, and 110 which are paired with respective hinges 116, 114, and 112 of upper shield railing 118. As with upper shield railing 58, upper shield railing 118 may be placed in various positions relative to lower shield railing 104. For example, upper shield railing 118 may be folded up to keep a patient and their belongings in the bed, as illustrated in FIG. 41. Lower shield railings 66 and 104 may be moved independently of each other, as desired or needed.

In an approximate medial portion of rotating frame 88 is included a platform 84 and, to the left and right of platform 84, respective holes 85 and 92. At a foot end (as illustrated in FIG. 6), rotating frame 88 includes seating 86, which is to be removably placed on base 6, as illustrated in FIG. 7. At a head end (as illustrated in FIG. 6), rotating frame 88 includes seating 82, which is to be removably placed on base 16, as illustrated in FIG. 7.

FIG. 7 illustrates an example in which the features illustrated in FIGS. 1-3 and 6 have been connected together, and rotating frame 88 has been rotated to the patient's left. FIG. 7 further illustrates knee pad 119, which is shown in greater detail in FIG. 34, which prevents contact of the knees and the ankles while rotating a patient within rotating frame 88. FIG. 7 further illustrates mattresses placed above rotating frame 88, which are discussed in more detail with respect to FIGS. 35-37.

Figure 8:
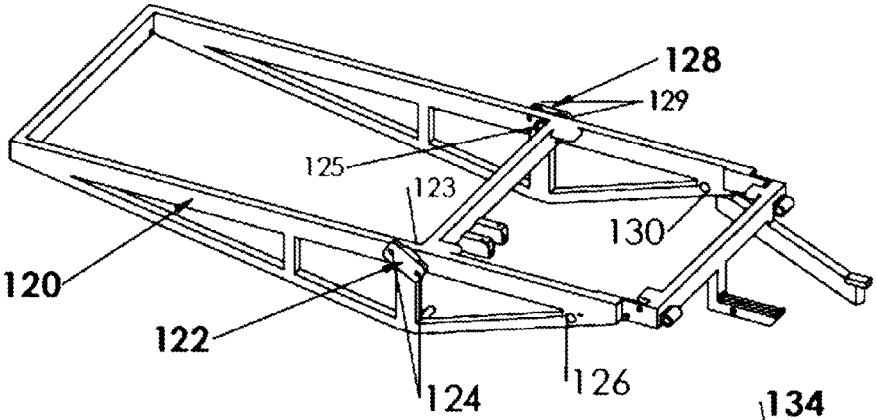
FIG. 8 illustrates an example of tilting frame 120.
Figure 29:
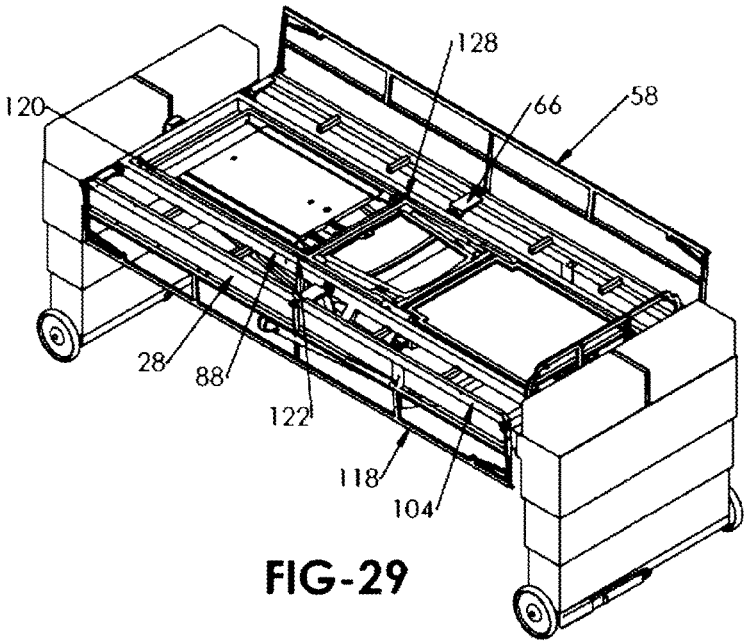
FIG. 29 illustrates an example in which the features illustrated in FIGS. 1-28 have been connected together.

FIG. 8 illustrates an example of tilting frame 120. Tilting frame 120 includes two connectors 122 and 128 with respective sets of holes 124 and 129 which are respectively attached to holes 92 and 85 in rotating frame 88, as illustrated in FIG. 10, and comprising at least one limit switch (not illustrated) whereby the limit switch may be set to a desired or needed angle, so that the angle of tilting does not exceed a determined amount. In some examples, the limit switch may be implemented by a simple electromechanical switch at the end of a range of travel. In some examples, the limit switch may be implemented by software in response to detected changes in angle or position. Via connectors 122 and 128 tilting frame 120 tilts on hinges, as illustrated in FIGS. 10 and 29. Tilting frame 120 tilts along an axis perpendicular to the axis of rotation of rotating frame 88. In some examples, tilting frame 120 can be adjustably tilted up at least 60 degrees from its horizontal position. In some examples, tilting frame 120 can be adjustably tilted up to approximately 85 degrees from its horizontal position, much as illustrated in FIG. 10. In some examples, the angle of tilt of tilting frame 120 and the angle of rotation of rotating frame 88 can be changed simultaneously. Each of connectors 122 and 128 has been built up of a plate having two holes on each 124 and 129 and a short shaft, at the middle, that all join as the base of pivot in bearings 123 and 125.

Figure 9:
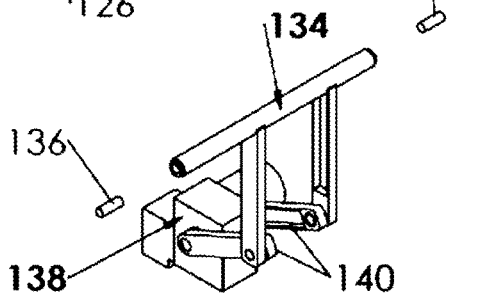
FIG. 9 illustrates an example of actuator 138 for tilting frame 120 and associated components.

FIG. 9 illustrates an example of actuator 138 for tilting frame 120 and associated components. Actuator 138 includes a 24 VDC motor which transmits force to tilt tilting frame 120 via arms 140 and 134. The axis of a hinge tube of arm 134 is aligned with the axes of the holes 126 and 130 in tilting frame 120 and connects thereto via pins 132 and 136. Actuator 138 is attached to platform 84 of rotating frame 88.

FIG. 10 illustrates an example in which the features of FIGS. 1-3, 6, 8, and 9 have been connected together, and tilting frame 120 has been tilted up into a vertical angle by actuator 138. Actuator 138 is able to tilt tilting frame 120 to any desired angle between a horizontal angle (illustrated in FIG. 29) and the vertical angle.

Figure 11:
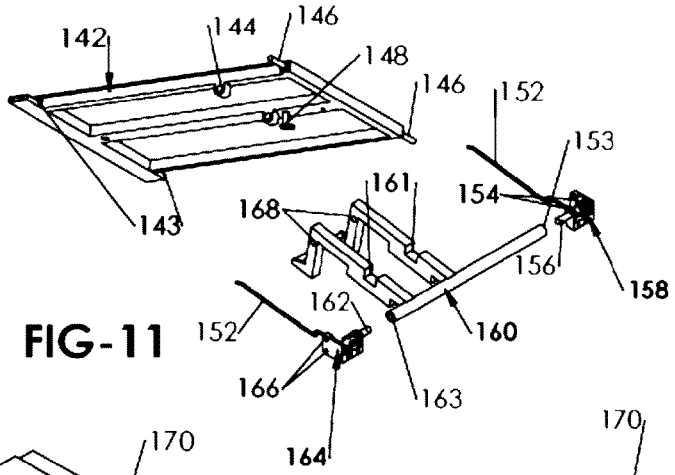
FIG. 11 illustrates examples of components for performing various movements of a patient's knees and legs.

FIG. 11 illustrates examples of components for performing various movements of a patient's knees and legs. The elements of the structure for choosing the knees' movement are shown in FIG. 11, and comprising at least one limit switch (not illustrated) which controls the extent of an angle of rotation from a horizontal position. In some examples, the limit switch may be implemented by a simple electromechanical switch at the end of a range of travel. In some examples, the limit switch may be implemented by software in response to detected changes in angle or position. Lower leg plate 142 is positioned on a platform 143 that includes pivots 144, lock 148, and two shafts 146 on each side of platform 143. Turning arm 160 includes a hinge tube which on one end 153 is mounted on shaft 156 and, on the other end 163 on shaft 162, and enjoys the freedom for turning around their common axis. Turning arm 160 rotates about an axis parallel to the axis on which tilting frame 120 tilts. Turning arm 160 includes pivots 168 which are joined, via pin 176 of actuator 182 illustrated in FIG. 16, with pivots 144. Providing that lock 148 is open, lower leg plate 142 can turn around the axis of the pin 176. Lower leg plate 142 includes indentations 161 which enable lower leg plate 142, when it is horizontal, to provide a level surface in balance with other components of the bed.

Figure 12:
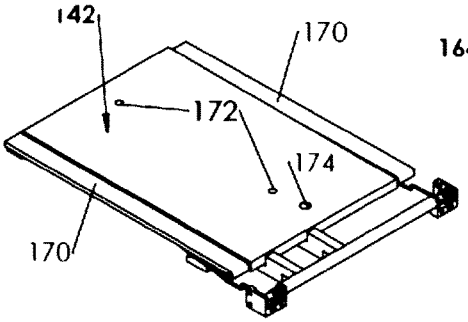
FIGS. 12-15 illustrate various example movements of the components illustrated in FIG. 11.
Figure 13:
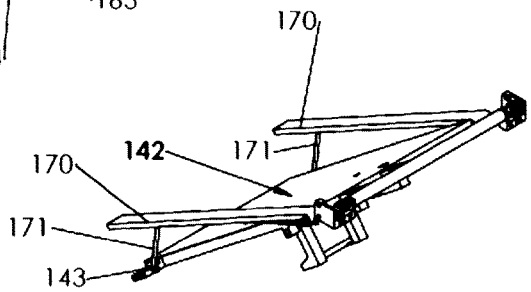
Figure 20:
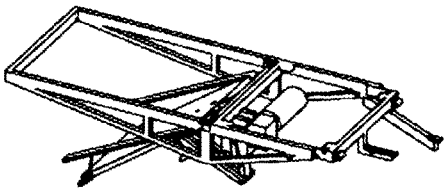

FIGS. 12-15 illustrate various example movements of the components illustrated in FIG. 11. In these and other drawings, at least two side plates 170 are installed. At least two receptacles 172 are included at the approximate medial of lower leg plate 142 to accommodate attaching instruments or components, such as knee pad 119 illustrated in FIG. 7. Lower leg plate 142 also includes a receptacle 174 for access to the lock 148. The two side plates 170 are put on, and rotate about shafts 146 of lower leg plate 142, as illustrated in FIGS. 12, 13, and 20. Lower leg plate 142 further includes platforms 143, which limit the turning of side plates 170.

FIG. 12 illustrates an example in which a patient's legs are held horizontal and level by moving lower leg plate 142 into a horizontal and level position, as illustrated, for example, in FIGS. 21, 28, 29, 33, and 35-37. There are various other arrangements of the bed and its components in which the components illustrated in FIG. 12 may be similarly positioned relative to one another, such as, for example, FIGS. 43 and 44. In this example, as well as in FIGS. 14 and 15, side plates 170 remain substantially parallel to lower leg plate 142.

FIG. 13 illustrates an example in which a patient's legs have been lowered to a desired angle by moving lower leg plate 142 and turning arm 160 downward about the axis of the hinge tube of turning arm 160, as also illustrated in FIG. 20. In this example, as lower leg plate 142 moves downward from a horizontal position, springs 152 under each of side plates 170 initially prevent the side plates 170 from going downward along with lower leg plate 142. However, once lower leg plate 142 turns downward a sufficient amount, flexible belts 171, which connect lower leg plate 142 to side plates 170, flexible belts 171 will pull side plates 170 downward in harmony with lower leg plate 142. These movements and their order are for the purposes of safety and avoidance of the leg to be placed among the bed's elements whilst the leg is being moved up to horizontal.

Figure 14:
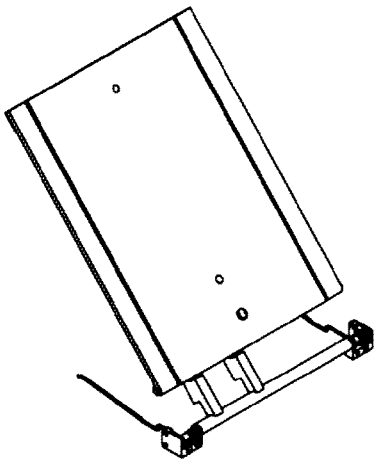
Figure 15:
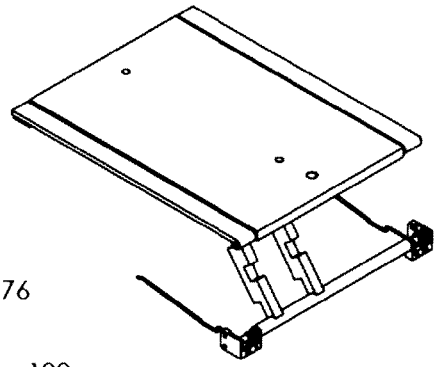
Figure 18:
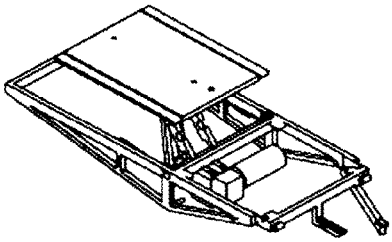
FIGS. 18-21 illustrate various example movements of the components illustrated in FIGS. 11-17.
Figure 19:
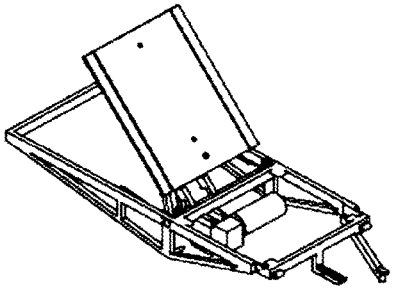

FIG. 14 illustrates an example in which a patient's legs have been raised at a desired angle by moving lower leg plate 142 and turning arm 160 upward about the axis of the hinge tube of turning arm 160, as also illustrated in FIG. 19. Lock 148 is not released, which keeps lower leg plate 142 at a common angle with turning arm 160. This is referred to as the "sport mode" for lower leg plate 142. FIG. 15 illustrates an example similar to the example of FIG. 14, but in which lock 148 is released, allowing a patient's legs to be raised in a more relaxed position, as also illustrated in FIG. 18. This is referred to as a "resting" or "relaxed" position for lower leg plate 142.

Figure 16:
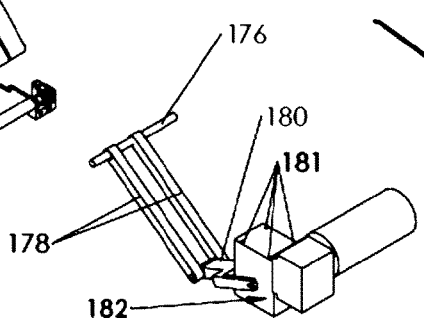
FIG. 16 illustrates an example of an actuator 182 for lower leg plate 142 and related components.

FIG. 16 illustrates an example of an actuator 182 for lower leg plate 142 and related components. Actuator 182 includes a 24 VDC motor which transmits force to lower leg plate 142 via arm 180, arms 178, and pin 176. Movement of lower leg plate 142 by actuator 182 is illustrated in FIGS. 18-21.

Figure 17:
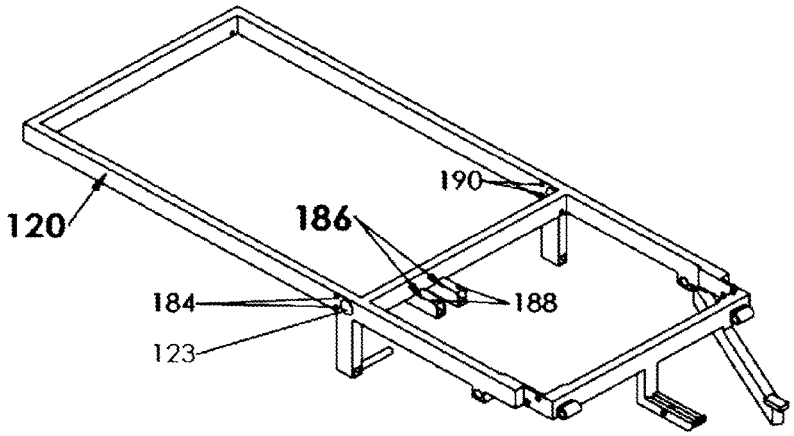
FIG. 17 illustrates an example of points and features on tilting frame 120 for attaching the components illustrated in FIGS. 11, 13, and 16.

FIG. 17 illustrates an example of points and features on tilting frame 120 for attaching the components illustrated in FIGS. 11, 13, and 16. For the convenience of explanation, some of the supporting members of tilting frame 120 illustrated in FIG. 8 are not included in FIG. 17, although the structure illustrated in FIG. 17 may also be considered an alternative example of tilting frame 120. Actuator 182 of FIG. 16 is attached by way of bolts, screws, or other fasteners using holes 181 therein to corresponding holes 188 in seating 186 of tilting frame 120. Mounts 158 and 164, illustrated in FIG. 11, are attached via respective holes 154 and 166 to respective holes 190 and 184 in tilting frame 120. With the further connection of arms 178, through the pin 176 illustrated in FIG. 16, with pivots 168 and pivots 144 illustrated in FIG. 11, controlled movement of tilting frame 120 by actuator 182 becomes effective.

Figure 21:
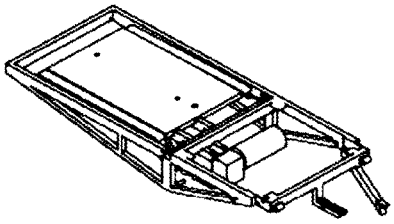

FIGS. 18-21 illustrate various example movements of the components illustrated in FIGS. 11-17. FIG. 18 illustrates lower leg plate 142 in a position corresponding to the example of FIG. 14. FIG. 19 illustrates lower leg plate 142 in a position corresponding to the example of FIG. 15. FIG. 20 illustrates lower leg plate 142 in a position corresponding to the example of FIG. 13. FIG. 21 illustrates lower leg plate 142 in a position corresponding to the example of FIG. 12, which may be referred to as a "home" position.

Figure 22:
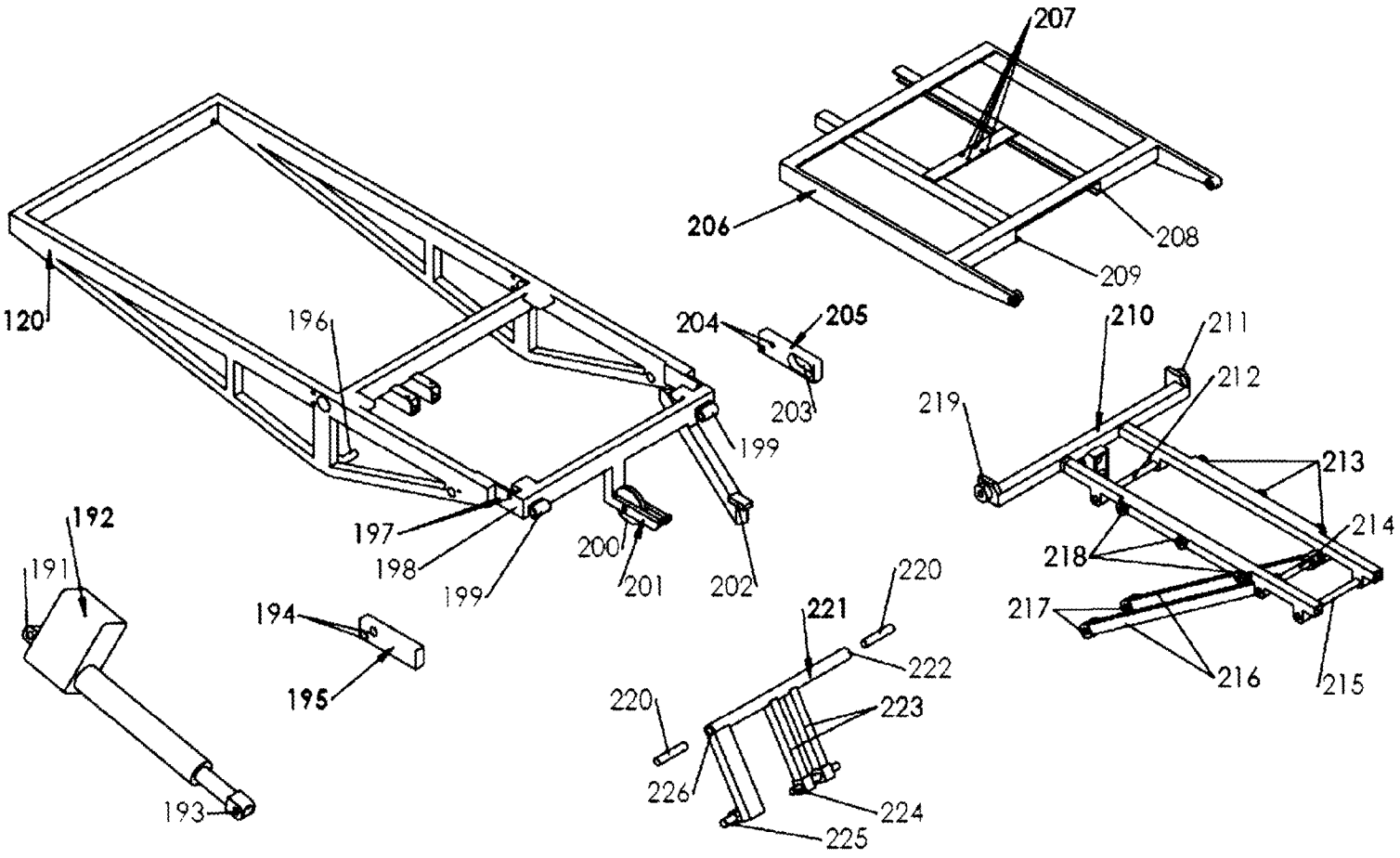
FIG. 22 illustrates examples of components used to facilitate sitting movements and positions for a patient.

FIG. 22 illustrates examples of components used to facilitate sitting movements and positions for a patient. Some examples include at least one limit switch (not illustrated) to prevent the extent of sitting rotation from exceeding a desired or needed predetermined value. In some examples, the limit switch may be implemented by a simple electromechanical switch at the end of a range of travel. In some examples, the limit switch may be implemented by software in response to detected changes in angle or position. Actuator 192 includes a hole 191 for attachment to tilting frame 120 using pin 196 on tilting frame 120, and a hole 193 for attachment to pin 225 of linkage 221, as further illustrated in FIG. 24. FIG. 22 illustrates an example in which actuator 192 is a linear actuator. A hinge tube of linkage 221 is pivoted, through pins 220, on pivots 199 included in tilting frame 120. By increasing or decreasing the distance between holes 191 and 193 by operation of actuator 192, arms 223 of linkage 221 are moved, transmitting the mechanical power of actuator 192 through arms 216, which are attached to arms 223 via pins 224 and pivots 217. At the end opposite from pivots 217, arms 216 are connected through pin 214 to torso frame 210. Torso frame 210 is connected via two connectors 195 and 205 to tilting frame 120. Connector 195, being a mirror image or duplicate of connector 205, includes drawer 203 and is attached to tilting frame 120 using holes 194 in connector 195 and respective holes 197 in tilting frame 120. Connector 205 is similarly attached to tilting frame 120 using holes 204 therein.

Figure 23:
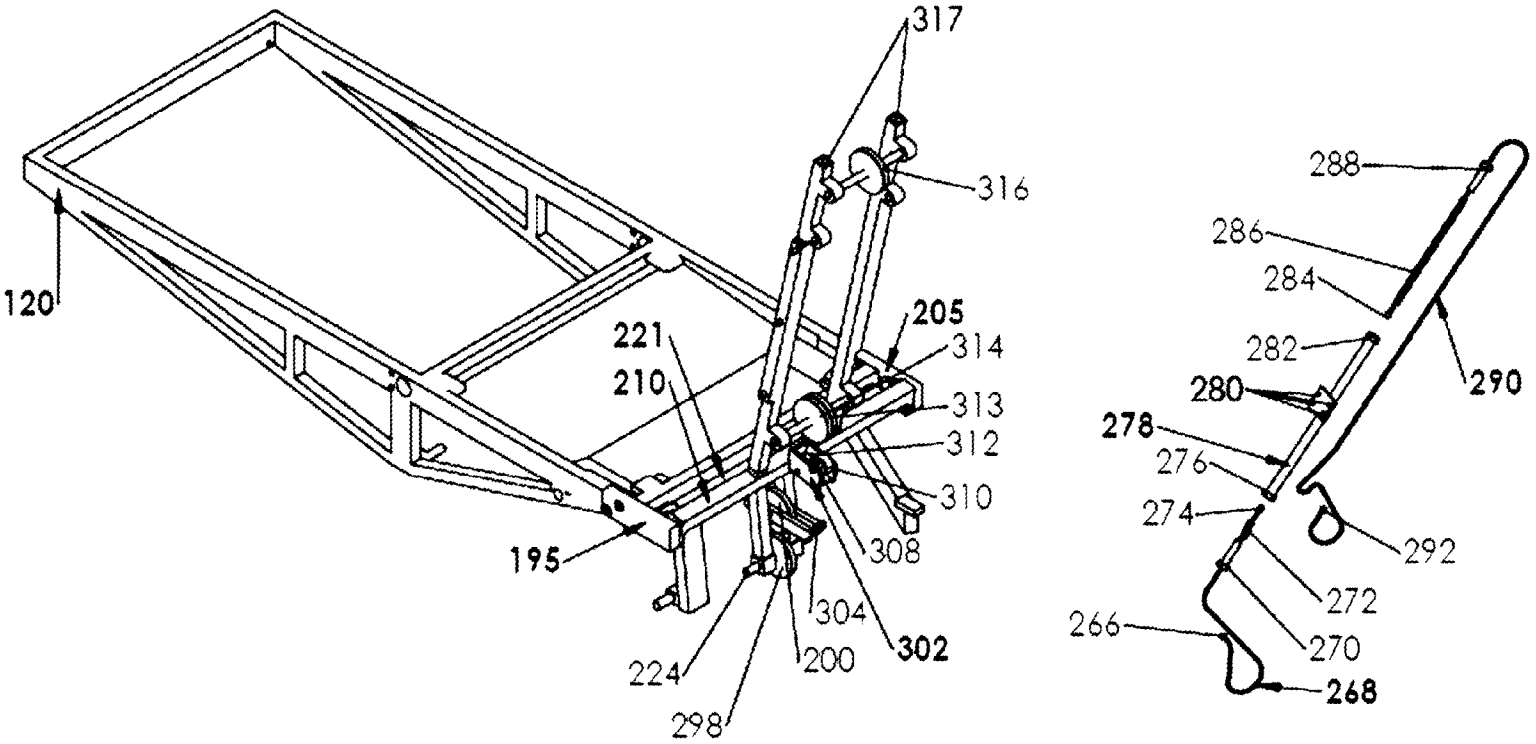
FIG. 23 illustrates an example of a cable system for aligning and controlling the linear movement of torso support 206 on torso frame 210.

Rollers 211 and 219 are placed on respective sides of torso frame 210 and placed in drawers 203 of connectors 195 and 205. Drawers 203 have a horizontally elongated shape which allows torso frame 210 to perform at least two types of movements: a repeatable-short linear and a rotary. The repeatable-short linear movement creates a tensional movement that tensional movement that in addition to various benefits for the vertebral column, muscle, blood circulation, and supine skin integrity, it massages and exercises the muscles and the bones of the back. It can further be configured to help adjust the axis of rotation of torso frame 210 with a patient's pivotal point on their hip bones. Rotary movement of torso frame 210 occurs when the rollers 211 and 219 of torso frame 210 reach to a distal end of drawer 203 of connector 205 and its mirror image of connector 195 respectively around an axis parallel to the axis on which tilting frame 120 tilts. FIG. 23 illustrates an example in which torso frame 210 has been rotated upward, such as might be performed to enable a patient to sit upright in the bed. The sides of torso frame 210 include rollers 213 and 218, which allow linear movement of torso support 206 by use of rails 208 and 209 that engage with respective rollers 213 and 218. Torso frame 210 also includes bearings that support pins 212 and 215.

FIG. 23 illustrates an example of a cable system for aligning and controlling the linear movement of torso support 206 on torso frame 210. Cable connector 278 includes threads 276 and 282 to accept bored screws 274 and 288 at opposing ends and also a plate at its middle including holes 280. Cable connector 278 is attached to torso support 206 using bolts, screws, or other fasteners between holes 280 in the plate of cable connector 278 and respective holes 207 in torso support 206. A first cable 290 enters, through a cable-head 284 and a spring 286, to the cable connector 278 and connects to it, controllably, through bored screw 288. There is a cable stopper at the other end of the cable 290 passing through rollers 314 and 316 and then roller 310 and 312 of base 302 and roller 200 illustrated in FIG. 22 and then is secured to notch 308. Base 302 is a portion of torso frame 210. A second cable 268 enters, through a cable-head 274 and a spring 272, to the cable connector 278 and connects to it through an adjustable bored screw 270. There is a cable stopper 266 at the other end of the cable 268 passing over rollers 298 and 313 and then is secured to notch 304 at the distal end of base 201. Therefore, in response to controlled changings in the angle of the torso frame, one of corresponding cables 268 and 290 can be pulled or released accordingly and the cable connector 278 will be affected by the forces and can move the torso support 206 either further or closer to the tilting frame 120.

In connection with moving torso frame 210 to and from a "sitting mode," the first cable 290 and pulleys 200, 310, 312, 313 and 316 are utilized. Pulley 200 is mounted on base 201 and is fixed with respect to the tilting frame 120. Pulleys 310 and 312 are mounted on the base 302 of the torso frame 210. Pulleys 313 and 316 are set on respective pins 212 and 215 of torso frame 210.

While changing the mode of torso frame 210 with respect to tilting frame 120 when sitting, one side of the first cable 290 would be pulled and move the torso support 206 and accordingly a portion of the bed which is under the patient's torso would be synchronized with movement of the person's torso during the changing of the mode. The extent of this changing mode is adjustable by bored screws 270 and 288. Hence, a patient in the bed would not be pushed to the front, thereby proving a comfortable true and complete sitting position while eliminating squishing and skin chafing during the sitting process. In some examples, sitting function, all knee functions, Trendelenburg position, or reversible Trendelenburg positions can be performed simultaneously. For return, the second cable 268 and pulleys 298 and 314 are used. The pulley 314 is set on the pin 212 of torso frame 210 and pulley 298 is held between legs 223 by pin 224. This mechanism moves along with the patient's spine and removes pushing a patient's body forward and avoids undesired pressure on the body when transitioning between sitting and horizontal positions. Springs 272 and 286 facilitate a proper tension in cables 268 and 290 respectively.

Figure 24:
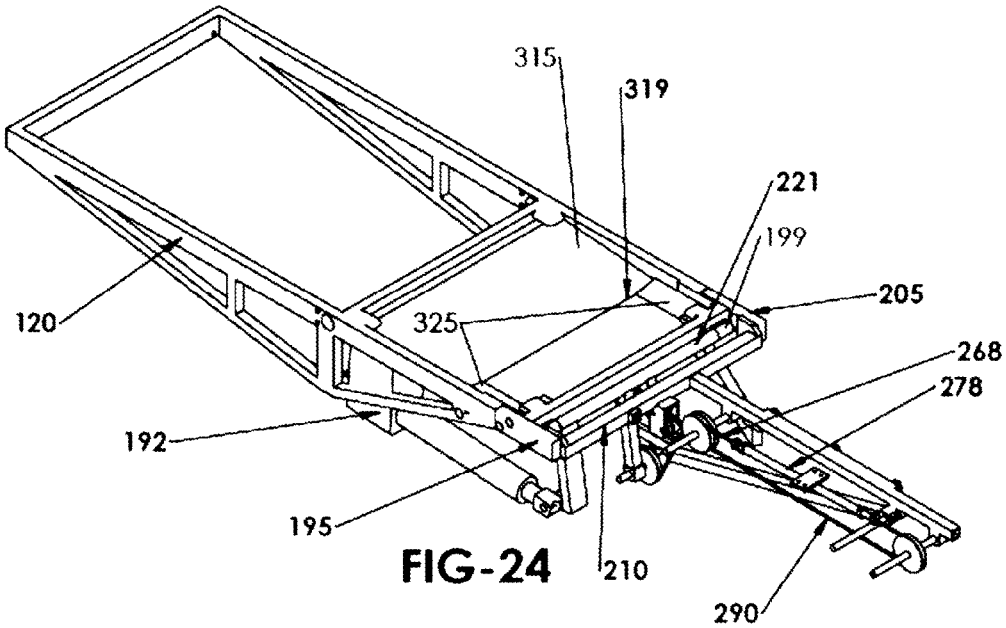
FIG. 24 illustrates an example in which features of FIGS. 22 and 23 have been connected together.

FIG. 24 illustrates an example in which features of FIGS. 22 and 23 have been connected together. However, part of torso frame 210 is omitted for the sake of presentation. FIG. 24 also illustrates a seat 319, which has gradient 315 and gradients 325, which prevent a patient from slipping to the front and sides while sitting.

Figure 25:
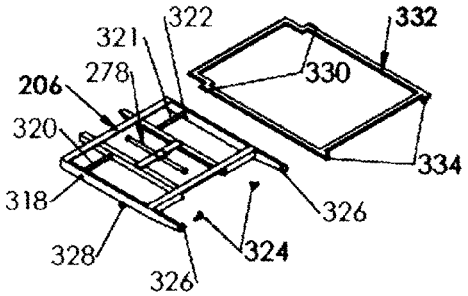
FIG. 25 illustrates an example of a torso plate 332 which is mounted on top of torso support 206.

FIG. 25 illustrates an example of a torso plate 332 which is mounted on top of torso support 206. Torso plate 332 can support a mattress or a portion of a mattress for an upper part of a patient's body. By use of belt attachments 330, torso plate 332 can revolve around holes 334 which are fixed to respective holes 326 in torso support 206 by use of pins 324. By attaching belts or such to belt attachments 330, torso plate 332 can be angled upward while a patient remains resting on torso plate 332. By revolving torso plate 332 upwards, it may be used as a drainage table. Similar movement of torso plate 332 in conjunction with resting position movement of lower leg plate 142 may also facilitate bathing, changing trousers, changing bedpans, or other patient activities.

Figure 26:
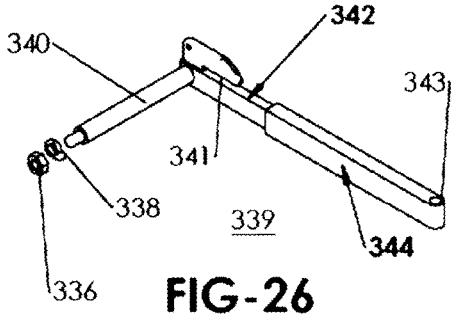
FIG. 26 illustrates an example of a first telescoping seat arm 339.

FIG. 26 illustrates an example of a first telescoping seat arm 339. The bed includes a second telescoping seat arm, which is a mirror image of the first telescoping seat arm 339. First telescoping seat arm 339 includes handle 340 which is coupled to inner arm bar 342 and is inserted into hole 318 of torso support 206 with the ability of moving inward and outward and rotation. The second telescoping seat arm is similarly inserted into hole 322 of torso support 206. When a patient is seated in the bed, the telescoping seat arms can be extended and adjusted to function as seat arms. The extent of rotation of the first telescoping seat arm 339 is adjustable by stop 338 and nut 336 which are also used as guards while a patient is sitting. Slide 344 moves on handle 342 to provide the ability of extending the length in a telescoping manner. At the end of slide 344 is an end hole 343 which may be used for securing a table for eating, work, or other activities.

Figure 27:
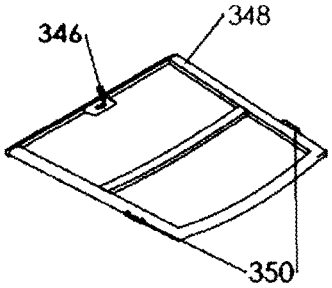
FIG. 27 illustrates an example of a portable seat 348 useful for moving a patient in or out of the bed.

FIG. 27 illustrates an example of a portable seat 348 useful for moving a patient in or out of the bed. Portable seat 348 includes at a lap end a hole 346 in a specific format and on two rear sides belt attachments 350. By attaching belts or such to each of notch 346 and belt attachments 350, a patient seated on portable seat 348 may be moved out of the bed without the need for a conventional sling. By being able to separate portable seat 348 from the bed, it can be used to more easily transfer a patient between the bed and a wheelchair.

Figure 28:
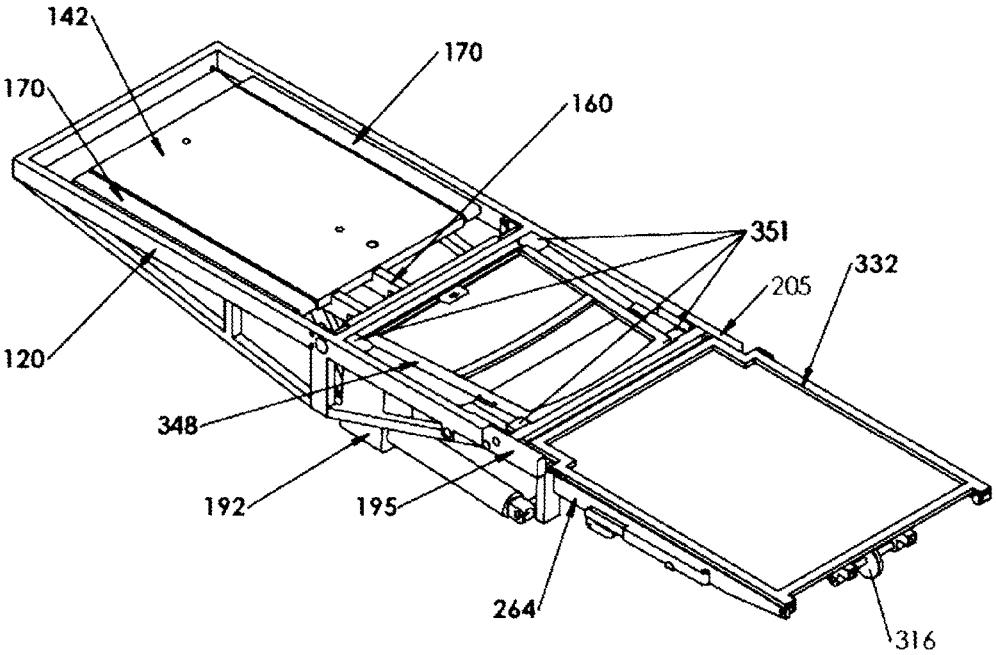
FIG. 28 illustrates an example in which the features illustrated in FIGS. 24-27 have been connected together and the torso frame is in a "home" position.

FIG. 28 illustrates an example in which the features illustrated in FIGS. 24-27 have been connected together and the torso frame is in a "home" position. FIG. 28 also illustrates four guides 351, which facilitate proper positioning of portable seat 348 on top of seat 319.

FIG. 29 illustrates an example in which the features illustrated in FIGS. 1-28 have been connected together.

Figure 30:
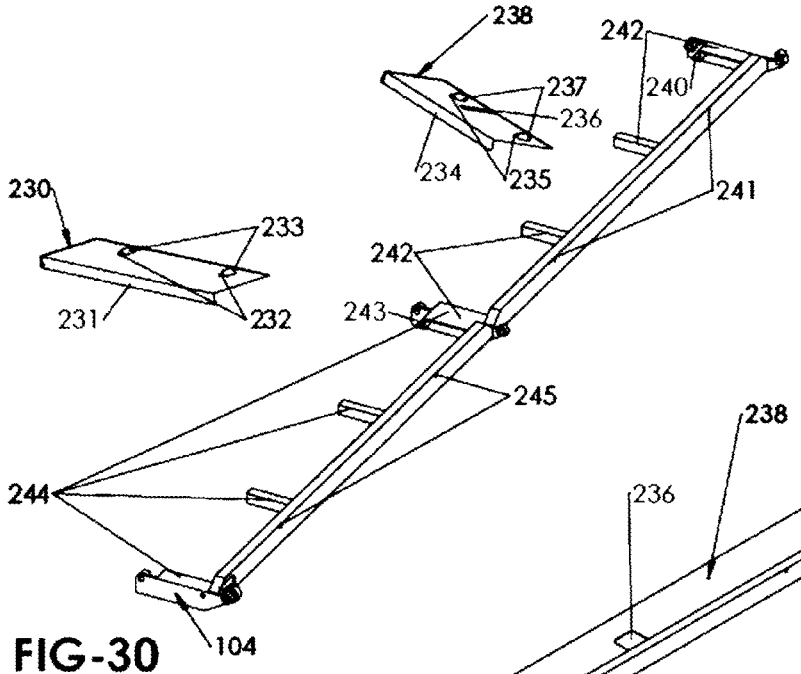
FIG. 30 further illustrates lower shield railing 104 illustrated in FIG. 6 and associated trays 230 and 238.

FIG. 30 further illustrates lower shield railing 104 illustrated in FIG. 6 and associated trays 230 and 238. Lower shield railing 104 includes bars 242 and 244 and holes 241 and 245. The two trays 230 and 238 are removably placed on the lower shield railing 104 and have respective bends 231 and 234 and pins 232 and 235 which are fixed by pieces 233 and 237 to them. The tray 234 also has a notch 236.

Figure 31:
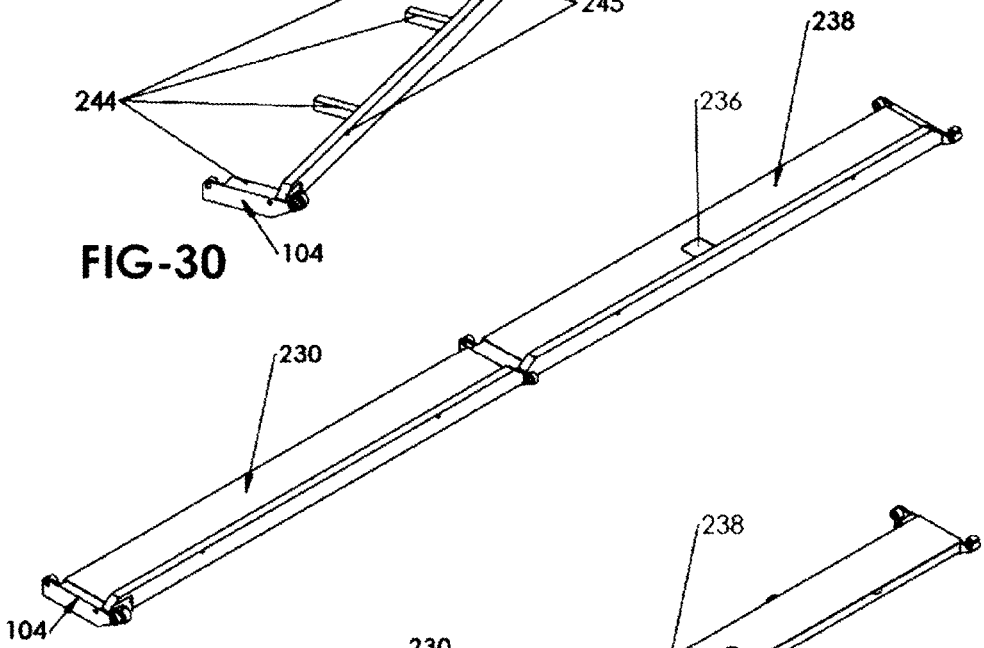
FIG. 31 illustrates an example in which trays 230 and 238 are placed on lower shield railing 104 when lower shield railing 104 is in a "normal" position.

FIG. 31 illustrates an example in which trays 230 and 238 are placed on lower shield railing 104 when lower shield railing 104 is in a "normal" position. When lower shield railing 104 is in a "normal" position, as illustrated in FIG. 33, bend 231 would be situated on step 243 and a bottom surface of tray 230 on bars 244, and bend 234 would be situated on step 243 and a bottom surface of tray 238 on bars 242.

Figure 32:
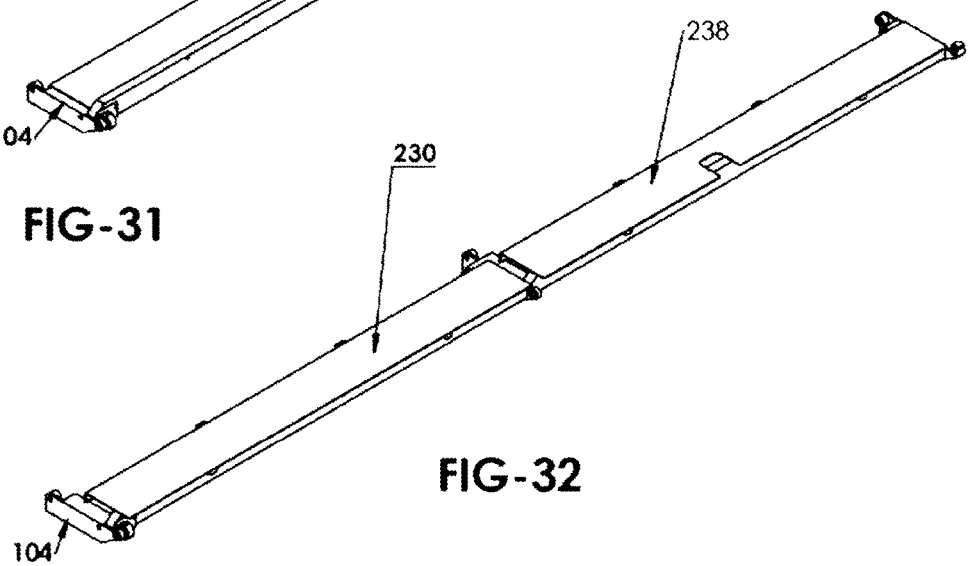
FIG. 32 illustrates an example in which trays 230 and 238 are placed on lower shield railing 104 in preparation for, or during, rotation of rotating frame 88, much as illustrated in FIG. 7.

FIG. 32 illustrates an example in which trays 230 and 238 are placed on lower shield railing 104 in preparation for, or during, rotation of rotating frame 88, much as illustrated in FIG. 7. In this configuration, when lower shield railing 104 becomes part of a shield to confine a patient being rotated, holes 245 and 241 accept respective pins 232 and 235, and bends 231 and 234 would be situated on respective bars 244 and 242. Considering the height of mattresses which may be used for the bed, this configuration, in addition to providing appropriate space for rotation of rotating frame 88 and lower shield railing 104, would help to guard and confine the patient while rotating. In some examples, the lower shield railings 104 when in guarding position and in combination with knee pad 119 of FIG. 34 prevent sliding of a patient during a rotation; whereby the angle of rotation of the multifunctional and multi-positional bed exceeds the angular rotation of conventional rotating beds.

Figure 33:
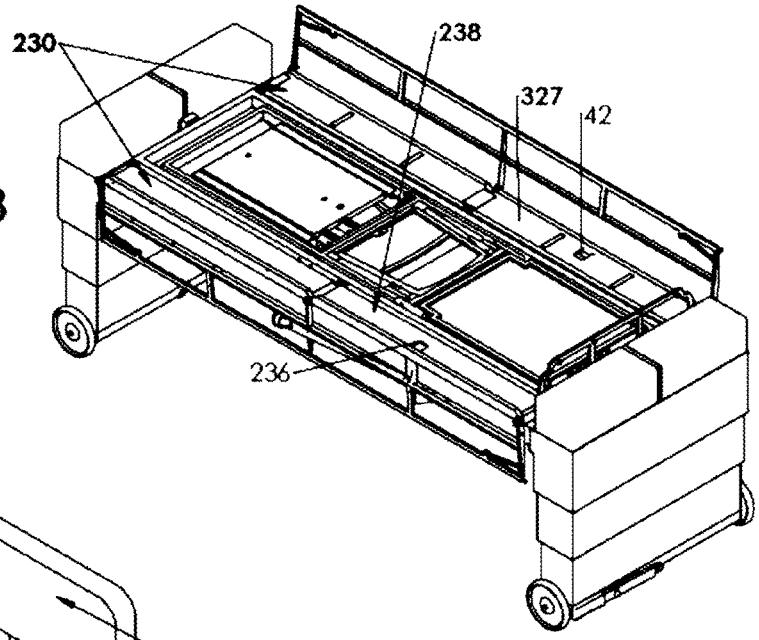
FIG. 33 illustrates an example with trays 230, 238, and 327 and the bed while lower shield railings 66 and 104 are each in "normal" positions.

FIG. 33 illustrates an example with trays 230, 238, and 327 and the bed while lower shield railings 66 and 104 are each in "normal" positions. Tray 327 is a mirror image of tray 238.

Figure 34:
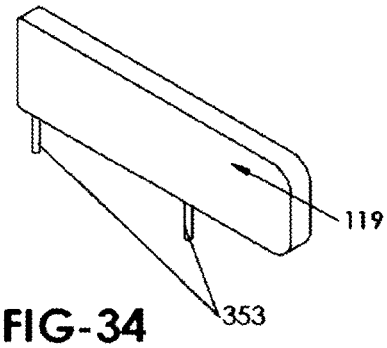
FIG. 34 illustrates an example of knee pad 119 used during rotation of rotating frame 88.

FIG. 34 illustrates an example of knee pad 119 used during rotation of rotating frame 88. Knee pad 119 includes two pegs 353 which are placed in holes 355 of lower leg plate 360 illustrated in FIG. 35. Use of knee pad 119 while rotating the patient prevents the lying of one foot on another, averts pressure or abrasion of the knees and ankles on each other, and prevents sweating between the patient's legs therefore prevents bed sores on the patient's legs.

FIG. 35 illustrates an example of the placement of various mattresses on the bed. Mattresses 354 and 364 may be placed on lower shield railing 66, mattresses 354 and 370 on lower shield railing 104, mattresses 356 on tilting frame 120, and mattresses 358, 360, 362 and 366 placed respectively on side plates 170, lower leg plate 142, portable seat 348, and torso plate 332, and a pillow 368. Further, FIG. 35 illustrates an example of a counterweight 350 having a receptacle 352 that is placed on the foot end of tilting frame 120. In the mattress 360 are included holes 355 and 357 which are respectively in line with holes 172 and 174.

Figure 36:
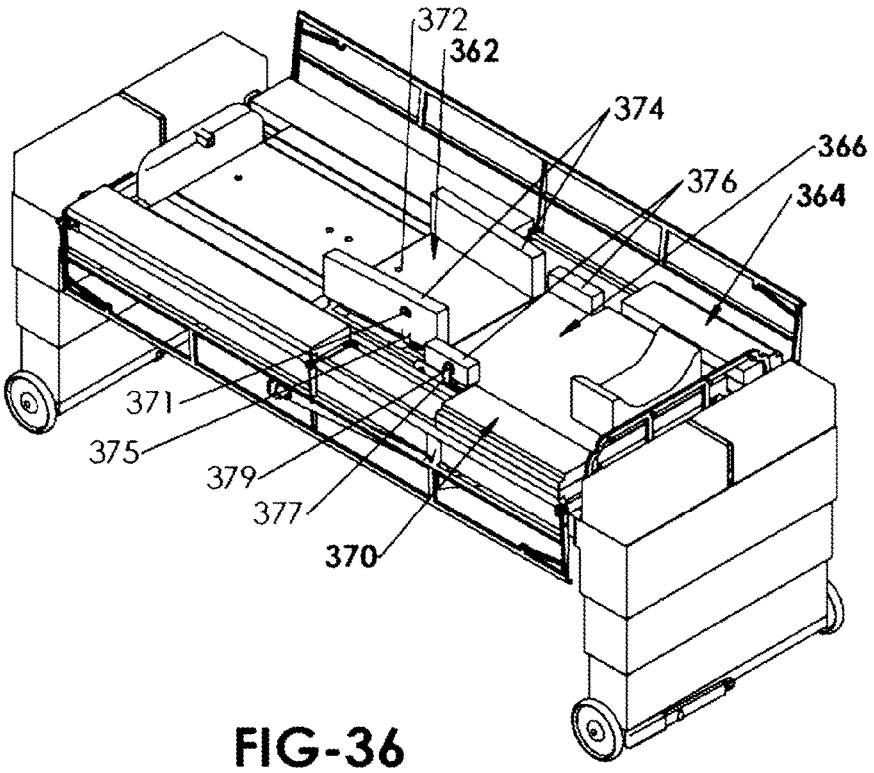
FIGS. 36 and 37 illustrate possible features of the mattresses 362, 364, 366, and 370 illustrated in FIG. 35.
Figure 37:
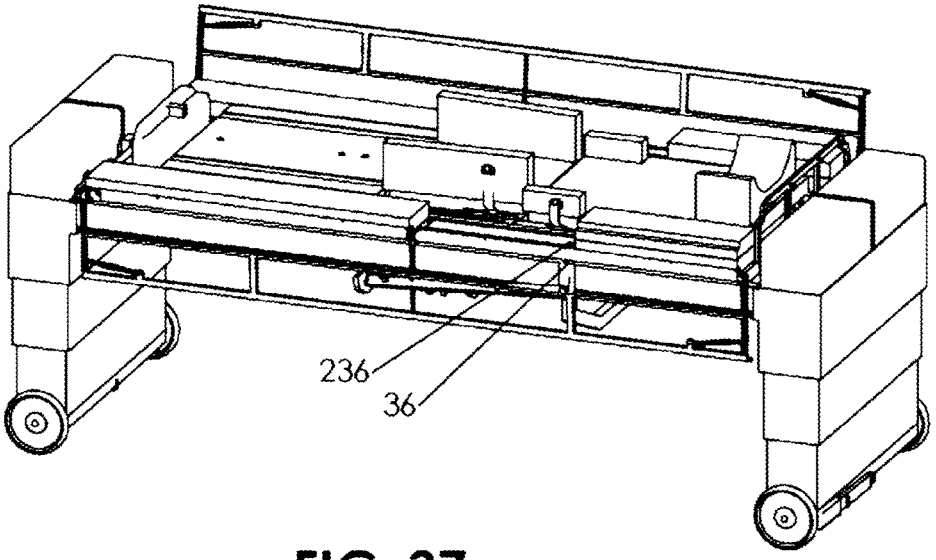

FIGS. 36 and 37 illustrate possible features of the mattresses 362, 364, 366, and 370 illustrated in FIG. 35. At least two side portions 374 of mattress 362 can be folded up to facilitate access to hooks 371 that are attached by belts 375 to belt attachments 350 of portable seat 348 illustrated in FIGS. 27-29, 33, and 35. Mattress 362 also includes a hole 372 that corresponds with hole 346 of portable seat 348. The two hooks 371 and the hole 346 are used to connect portable seat 348 to an elevator (not illustrated) for moving the patient out of the bed without a need for sling. Furthermore, a belt (not illustrated) can be attached to these hooks which prevents patient's slipping to or out of the front while being lifted.

Two side portions 376 of mattress 366 can be folded up to facilitate access to hooks 379 that are attached by belts 377 to the belt attachments 330 of torso plate 332. The two hooks 379 are used to connect torso plate 332 to an elevator (not illustrated) for performing drainage operation, trouser change, and other activities.

In FIGS. 36 and 37, mattresses 364 and 370 are each folded in half to provide access to notches 236 in trays 230 and 238 and receptacles 36 and 38, illustrated in FIG. 3, for receiving the elevator mentioned above and/or other accessories. While using the elevator and for preventing collapse of bed, the jack 28 illustrated in FIG. 3 should be activated.

As has been explained before, the lower shield railing 66 in its "normal" position, as illustrated in FIGS. 35-37, serves to provide a platform for supporting various mattresses, bedding, and the patient. However, during rotation of rotating frame 88 to the left or the right, as illustrated in FIG. 7, lower shield railing 66 and upper shield railing 58 are repositioned to serve as part of a shield or guard for the right side of the bed. Similarly, lower shield railing 104 and upper shield railing 118 would be repositioned to serve as part of a shield or guard for the left side of the bed.

Figure 38:
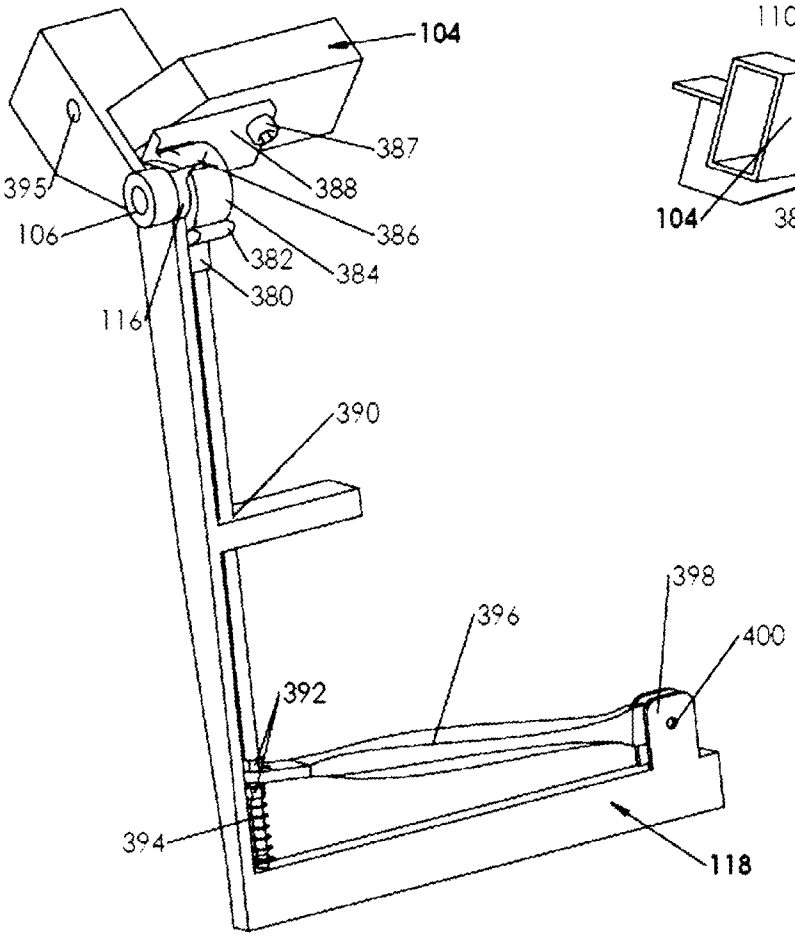
FIG. 38 illustrates details of an example relation between lower shield railing 104 and upper shield railing 118 located toward the foot-end of the bed.

FIG. 38 illustrates details of an example relation between lower shield railing 104 and upper shield railing 118 located toward the foot-end of the bed. Hinge plate 388 is couple by screws 387 to lower shield railing 104. Hinge plate 388 includes ring 384 with a notch 386 in it at an angle of 90 degrees from horizontal. Upper shield railing 118 includes guides 382 and 390. The guides 382 and 390 cab guide pin 380, which is pushed against ring 384 by spring 394. Handle 396 may be used to apply force counter to spring 394 in order withdraw pin 380 from ring 384 to unshield the bed to facilitate patient ingress and egress.

Figure 39:
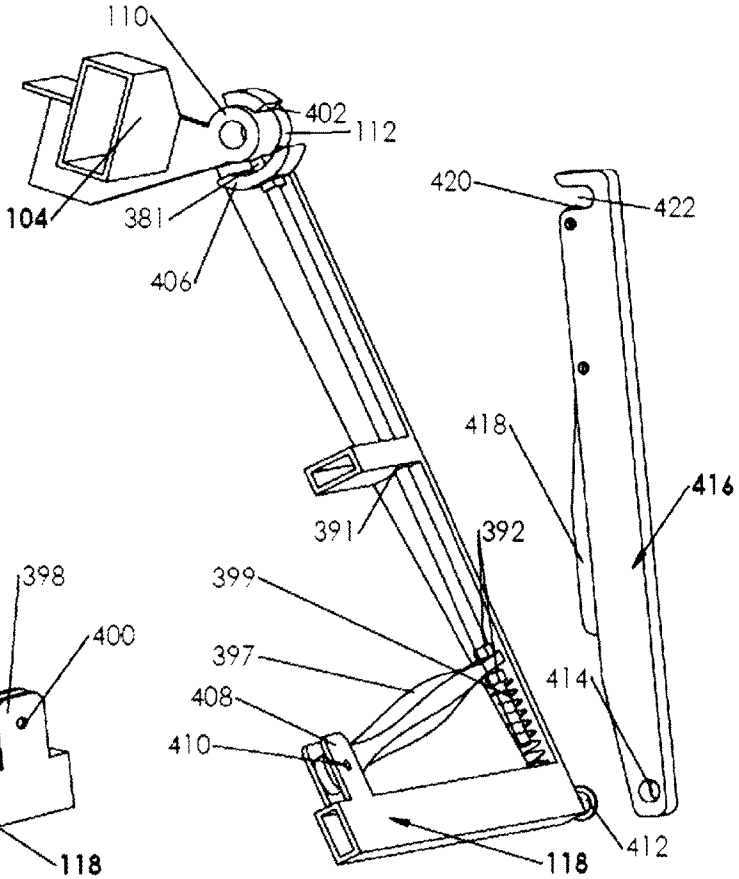
FIG. 39 illustrates details of an example relation between lower shield railing 104 and upper shield railing 118 located toward the head-end of the bed, along with a head safety lever 416.

FIG. 39 illustrates details of an example relation between lower shield railing 104 and upper shield railing 118 located toward the head-end of the bed, along with a head safety lever 416. Upper shield railing 118 includes guides 406 and 391, which direct pin 381 that is pushed on the hinge 110 outer surface by a spring 399. In some examples, the outer surface may be configured to have a step 402. Handle 397 may be used to apply force counter to spring 399 in order withdraw pin 381 from the hinge 110 outer surface. Upper shield railing 118 also includes pin 412 which passes through hole 414 at one end of head safety lever 416. The opposite end of head safety lever 416 includes a notch 422 with tang 420 located near the entrance of notch 422. Tang 420 freely rotates inward and allows notch 422 to sit on a pin of the appropriate diameter, such as pin 424 illustrated in FIG. 40. For removing head safety lever 416 from this pin, one needs to press ratchet 418.

Figure 40:
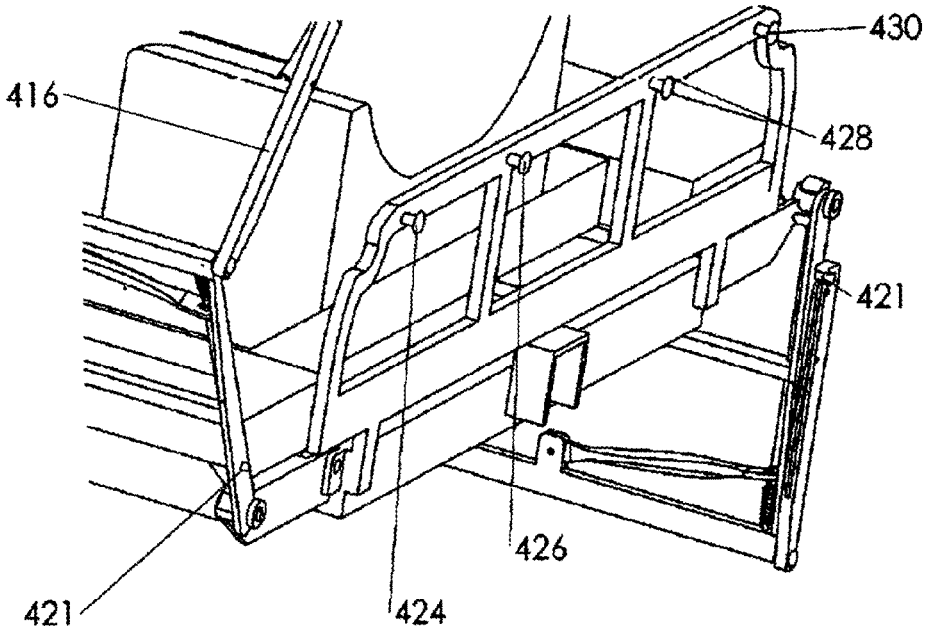
FIG. 40 illustrates an example of pins with which head safety lever 416 can be engaged.

FIG. 40 illustrates an example of pins with which head safety lever 416 can be engaged. In FIG. 40, a head guard of rotating frame 88 includes pins 424 and 430. When lower shield railing 104 and upper shield railing 118 are in a "normal" position, much as illustrated in FIG. 35 or 41, notch 422 of first head safety lever 416 attached to upper shield railing 118 may be engaged with pin 424. When lower shield railing 104 and upper shield railing 118 are positioned for rotation of rotating frame 88, much as illustrated in FIG. 7, notch 422 of first head safety lever 416 may be engaged with pin 426. Similarly, a second head safety lever 416 attached to upper shield railing 58 may engage with pins 430 and 428. Additionally, upper shield railings 58 and 118 each include pins 421 for securing their respective head safety levers 416 in place when not engaged with one of pins 424, 426, 428, or 430, as is illustrated with respect to the second head safety lever 416 in FIG. 40.

In order to locate upper shield railing 118 in its "normal" condition of bed guard, it is enough to rotate upper shield railing 118 around hinge 110 while squeezing the handle 397 with one hand until the pin 381 is pulled above step 402 and prepare the head safety lever 416 to be used with the other hand. This rotation would be continued until the pin 380 reaches notch 386 illustrated in FIG. 38; under pressure of the spring 394, pin 380 would enter notch 386 automatically and become fixed. Then, notch 422 of head safety lever 416 would be engaged with pin 424.

Preparing the bed for rotation only involves rotating upper shield railing 118 upward. With reference to FIG. 39, when upper shield railing 118 rotates upwards, pin 381 hits step 402 and lifts lower shield railing 104 along with itself. As illustrated in FIG. 42, when lower shield railing 104 rotates upwards, tang 440 moves on the top of belt 438 and ratchet 442 hits the barrier 444 and presses the leg safety lever 432. When tang 440 reaches the end of belt 438 it moves down, then the ratchet 442 releases and fits then notch 422 of head safety lever 416 should attached to upper shield railing 118 fits onto the pin 426 illustrated in FIG. 40. Similar action occurs for upper shield railing 58 and lower shield railing 66.

FIG. 41 illustrates an example in which upper shield railings 58 and 118 are each secured in their "normal" positions using head safety levers 416.

FIG. 42 illustrates an example in which upper shield railings 58 and 118 are each secured for rotation of rotating frame 88 using head safety levers 416 and leg safety lever 432. A first end of leg safety lever 432 is hinged to the hole 395 of lower shield railing 104, which is illustrated in FIG. 38. Leg safety lever 432 contains an internal spring (not illustrated) which constantly generates a force turning leg safety lever 432 in a counterclockwise direction (as illustrated in FIG. 42). A second end of leg safety lever 432 opposite from the first end includes tang 440 and ratchet 442 which is connected from inside to trigger and is under pressure to move forward by an inside spring and trigger guard 436. On the other hand plate 438 and the barrier 444 which is placed next to the foot-end of rotating frame 88 are involved in safety and maintenance of the rotary components.

Once rotation is completed, and it is desired to return upper shield railing 118 and lower shield railing 104 to their normal positions, one needs to pull the trigger guard 436 and rotate leg safety lever 432 clockwise and then release the trigger guard 436. Then, one releases head safety lever 416 as previously discussed.

Figure 43:
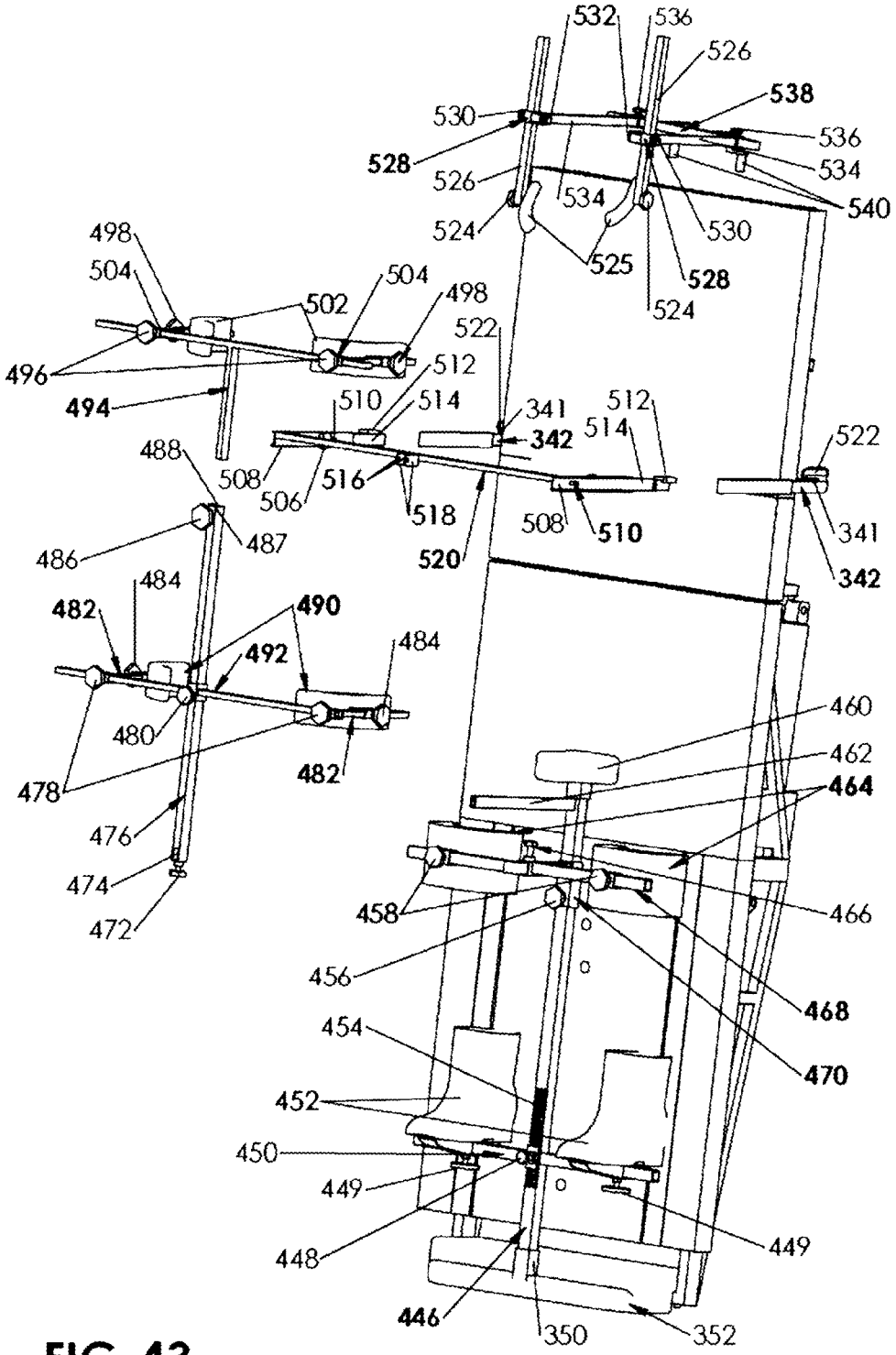
FIG. 43 illustrates examples of components which allow a patient, even in severe conditions of illness such as stroke, to stand so as to transfer the body weight to the long bones.

FIG. 43 illustrates examples of components which allow a patient, even in severe conditions of illness such as stroke, to stand so as to transfer the body weight to the long bones. For the convenience of explanation of these aspects, features illustrated in FIGS. 1-42 may be omitted in this figure. First, support 446 will be placed in receptacle 352 of FIG. 35. Support 446 at a middle downwards which is ragging with certain waves and for safety reasons something like a bicycle saddle would be installed at the end of it. To compensate for the height differences of patients, an adjustable sliding shoe base 450 is secured to the support 446 via lock 448. Space between shoes 452 installed on this component, set according to requirement and fixed by locks 449. Component 488 moves sliding on component 464 by interface 470 and fixed in the right place in front of patients' knees. Also by closing this component to the knees lock 466 would be fixed and halter the knees. Space between two halter knees 464 which are installed on this component would be coordinated with patients' knees and fixed by locks 458

The guard 520 will be installed on the handles 342, so as to halter the waist, in a manner that the tongues 512 on the sides will freely enter the vales 341 of the parts 342 of FIG. 26 and will be locked, once entrance, by the tongues 522 that impedes accidental exit thereof. This part, having the rails 510 that a portion of which can be seen and the locks 506, may be adjusted based on the patient's obesity. Then, the connector 476 will be affixed, from one hand, by placing on a proper seat on the crow 462 through its cut 474 and using the lock 472, and enters, on the other hand, into the cut in between the two bumps 518 and will be haltered through the holes 516 with a pin having a proper width. At the utmost upper limit of the connector 476 the bump 487 is improvised hinders the accidental separation of these two parts. The waists 490 will be haltered and affixed by the rails 492 and 482 and also the locks 478, 480 and 484.

For the bust to be haltered, it is enough to enter the T shape 494 into the hole 588 and to be affixed by the lock 486. Afterwards, the breast of the hitches 502, following to be placed on a proper seat, will be affixed through the rails 504 and the locks 496 and 498.

For the head to be haltered, it is enough to initially put the pillars 540 in the holes 317 of torso frame 210 and then to affix the front of the hitches 525 using the connectors 528, the rails 526, 534, 538 and the locks 524, 530, 532 and 536. It should be added that the entire adjustments, for a specified patient, have to be done just once.

Figure 44:
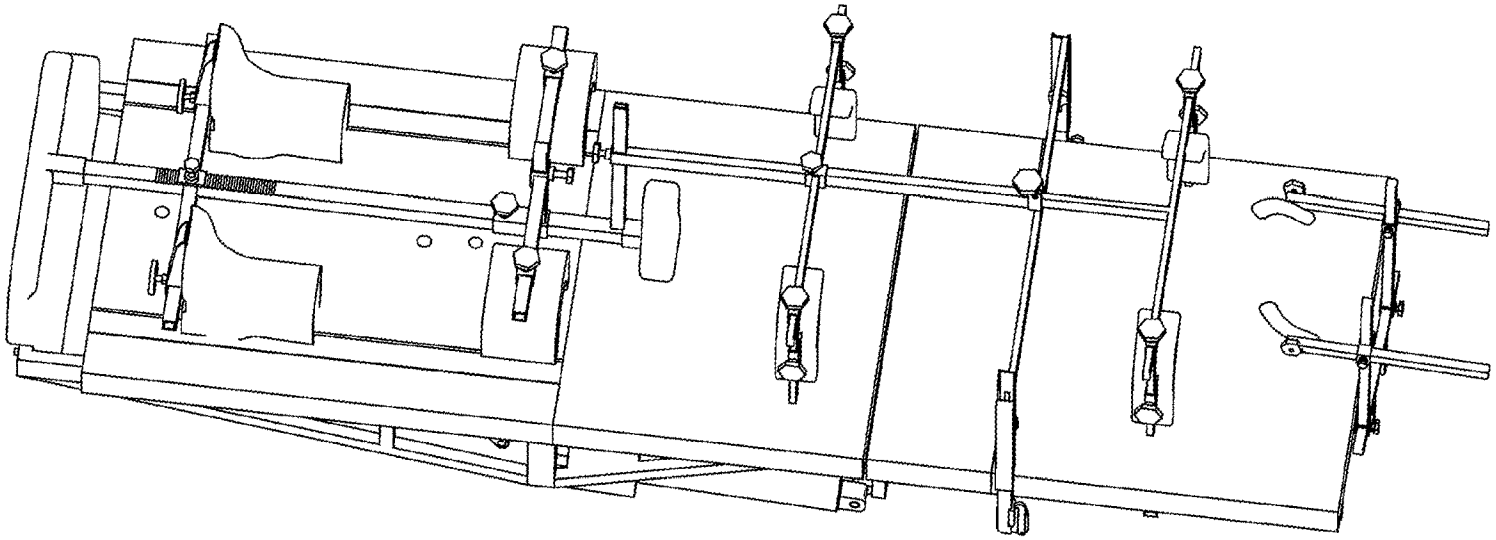
FIG. 44 illustrates an example in which the components illustrated in FIG. 43 have been connected together.

FIG. 44 illustrates an example in which the components illustrated in FIG. 43 have been connected together. One of ordinary skill in the art can envision how the structure illustrated in FIG. 44 may replace the tilting frame 120 illustrated in FIG. 10 to see how the bed operates with the patient in a standing position.

Figure 45:
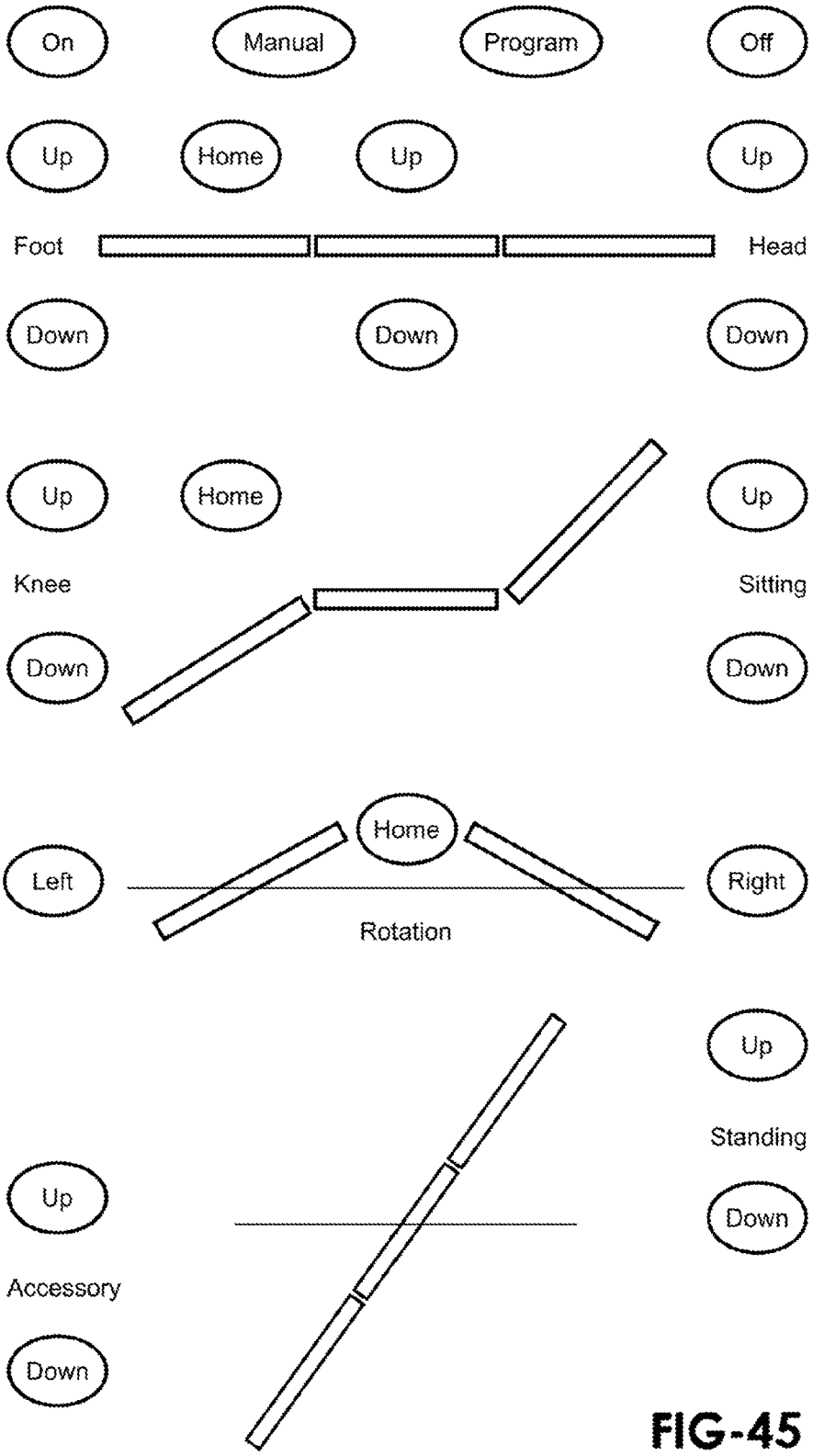
FIG. 45 illustrates an example of a control keyboard.

FIG. 45 illustrates an example of a control keyboard. For ease of working with the bed of the instant application, the control keyboard is programmed to move the bed in various directions and ultimately place the bed in various positions. A position called "home" can move the bed from any existing position to its "home" or original position. Other movements may include upward, downward, and/or rotational movements. The movements may be made possible via selection of certain commands on the control keyboard. The keyboard may be a physical keyboard or may be a user interface presented on a computer screen. Each of these movements may be associated with a specific section of the bed. As shown, the bed may have three sections, the upper section, the lower section and the middle section. Each section may include a button for moving that specific section of the bed in accordance with the selected movement action.

For safety and prevention of personal errors, some movements may be made conditional. The conditional movements may only be activated when conditions of these moves are recognized by controller 600 of FIG. 46. Otherwise, the conditional movements are not activated and the relevant alarm may be activated. The alarm may appear on the screen of the control mechanism or may be announced.

The commands once selected from the control mechanism may be communicated to the processor of the multipurpose orthopedic bed of the instant application. The communication between the control mechanism and the processor may be wired or wireless. The control mechanism may be a PC, tablet, a touch screen device, or a mobile phone, for example. The command may be communicated via touch, voice command, or even BMI.

In using the control mechanism, after connecting the bed to a power source and selecting the "ON" key on the control mechanism, only one of "manual" or "program" keys may be selected. If the "program" key is selected, the bed may move accordingly to one or more previously programmed movements. The movement may happen instantaneously or may be done in accordance with a specific time table. These movements may be previously programmed by a doctor or a nurse and may be specific for each patient. The movements may not need to be observed and the nurse or other persons can be busy with the other affairs or relax. When program mode is chosen, all the other command keys except the MANUAL and OFF keys will be inactivated and the speed of the actions will adjustably be reduced. In case of choosing the "manual" key, the other keys would be activated and the nurse or the person in charge would make the relevant movement by pressing the relevant key (e.g., up, down, rotate), while observing, of course at the time that the situation is provided. In manual mode, the speed of the action will be faster.

The movements of the ultimate repositioning bed and their corresponding start and stop time may be adjustable according to the patient's situation. The patient's situation may be assessed by his doctor and do not exceed from its limit. In one implementation, the bed or the control mechanism may be programmed over the air. For example, the doctor or the relevant specialists may connect to the bed or the control mechanism via Internet and change the settings of the bed or the control mechanism.

Figure 46:
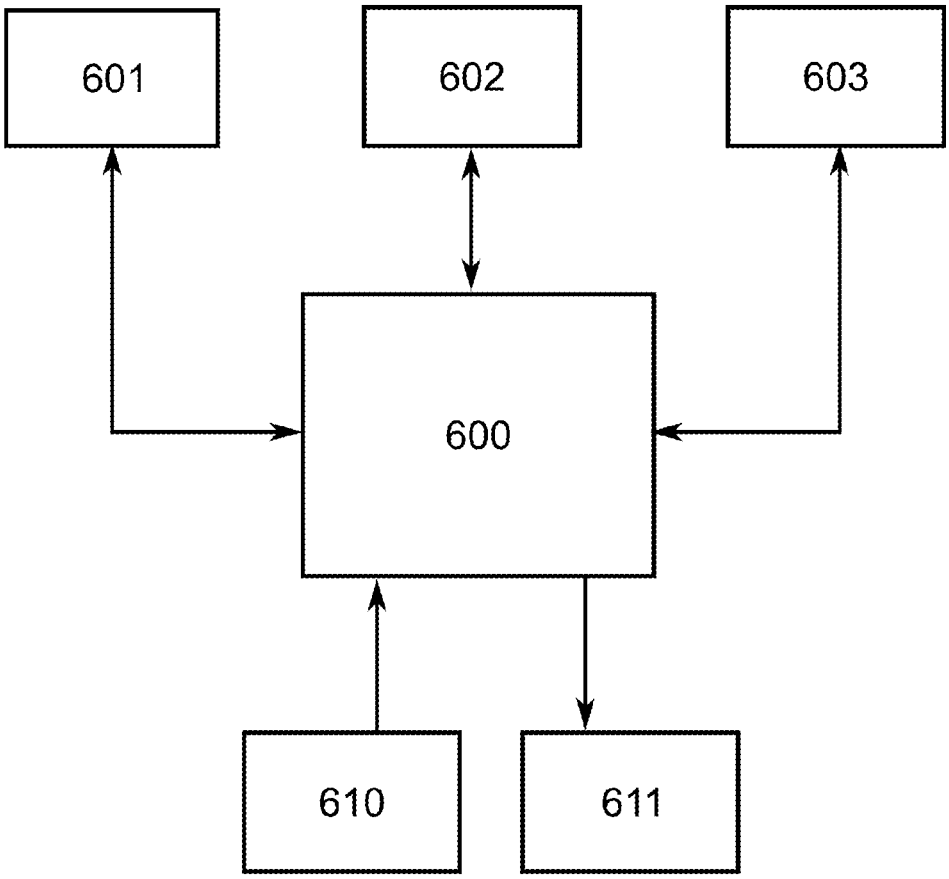
FIG. 46 illustrates an example of a controller at one end connected to the bed and its sensors and parts and at another end connected to the control mechanism.

FIG. 46 illustrates an example of a controller 600 at one end connected to the bed and its sensors 610, such as the limit switches mentioned above, and actuators 611 connected to the control mechanism. In some examples, the bed may be configured to have at least six actuators including: a first actuator facilitating the telescopic action of foot-end leg 1; a second actuator facilitating the telescopic action of head-end leg 11; a third actuator facilitating rotational movement of rotating frame 88; a fourth actuator facilitating movement of a patient's knees and legs; a fifth actuator providing tilting action; and a sixth actuator facilitating at first the axial and then the rotational movement of the torso frame 210. In some examples, some or all of the above actuators may not be included and in some other examples, some actuators could be added. The control mechanism may include a manual handheld control 603 or a PC 601 connected to the controller via internet or other device 602 with a user interface control.

Table 1 illustrates various exemplary bed movements. The mandate keys, which need preconditions are listed and located with their conditions on the left column of the table. Other mandate keys do not have any conditions.

| | Hands or feet home | Head or feet down | Sitting high | Knee high | Knee down | Rotation | Stand up <10° | Stand up >10° | Stand down >10° | Stand down <10° | Lift | Program |
|---|---|---|---|---|---|---|---|---|---|---|---|---|
| Hand & feet up | | | | | | | X | X | | | | |
| Hand & feet home | | | | | X | | | | | | | |
| Home sitting | | | | | | X | X | X | | | | |
| Home standing | X | X | X | X | X | X | | | | | | |
| Turning home | | | X | X | X | | X | X | | | X | X |
| Home jack | X | X | | | | | | | | | | X |

-continued

| | Hands or feet home | Head or feet down | Sitting high | Knee high | Knee down | Rotation | Stand up <10° | Stand up >10° | Stand down >10° | Stand down <10° | Lift | Program |
|---|---|---|---|---|---|---|---|---|---|---|---|---|
| Active jack | X | X | | | | X | X | X | | | X | |
| Knee home | | | | | | | X | X | | | | X |
| Support 446 installed | | | | | | | | X | | | | |
| Activation of shield 342 | | | | | | | | | X | | | |
| Protection home 342 | | | | | | X | | | | | | X |
| Components 55 and 104 in circulation | | | | | | | | | | | | |

Some of bed's movements or their combinations would omit the factors leading to bedsore such as, for example, pressure for a long time during the day and night. Also, some of the bed's movements facilitate the possibility of bedpan, bath, diaper or cloths changing. As a result, the bed of the instant application can keep patient's resting area and skin clean from bacterial and fungal problems. Moreover, using each of movements or their combination can reduce or eliminate stiff joints, weakened muscles, osteoporosis, infections and other problems that arise with patients requiring extended periods of bed rest. As a result, the life quality of these patients and their families can be enhanced substantially. Additionally, by keeping a patient's body more mechanically active, possible recovery can be accelerated.

Although most of the available beds claim to have sitting features, they are uniformly deficient in facilitating a comfortable and practical means of actual sitting; instead they cause squishing, skin chafing, and shifting/displacing of the patient. The examples described in this application utilize some new mechanisms which address such defects. Further, they provide features directed to reducing the load and strain on caregivers, the cost of caring for these loved ones, and provides advanced tools for the experts in the field to take advantage of.

Using this bed can help nurses with their jobs in addition to help address the possible shortage in nursing industry. It can also reduce the need for physical power, which can cause job accidents and injuries. In addition to the above facilities, the bed has other capabilities such as body building functions. Using the body building functionalities, for example, helps to improve the immune system and prevent urinary tract infection, respiratory tract infection, bone infections, and enhance a patient's well-being.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and may be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, should may they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A multi-positional bed for a patient, the multi-positional bed comprising:

a foot-end leg, at a first end of the bed;

a head-end leg at a second end of the bed opposite from the first end;

a rotating frame, supported by an upper portion of the foot-end leg, and by an upper portion of head-end leg, to be rotatable on a first axis, the first axis extending between the upper portion of the foot-end leg and the upper portion of the head-end leg; and a tilting frame, supported by the rotating frame, configured to selectively tilt on a second axis, the second axis being perpendicular to the first axis, wherein the tilting frame is configured to be capable of supporting the patient's entire body;

a lower leg plate, configured to support the patient's lower legs while the patient is lying on the bed;

a turning arm, configured to support the lower leg plate, and supported by the tilting frame, wherein the turning arm is configured to rotate both upward and downward around a third axis, wherein the third axis is parallel to the second axis and near the middle portion of the tilting frame;

a locking system configured to lock the lower leg plate and the turning arm together on demand; and a pivot, configured to attach the lower leg plate to the turning arm and configured to allow the lower leg plate to translate rotationally around a fourth axis parallel to the second axis and passing through the pivot, wherein the fourth axis is different from the third axis;

wherein the foot-end leg and the head-end leg are configured to be capable of being telescoped, while the patient is supported by the tilting frame, such that the height of the foot-end leg is lower than the height of the head-end leg and a slope of the first axis is at least 15 degrees, and such that the height of the foot-end leg is greater than the height of the head-end leg and the slope of the first axis is at least 15 degrees;

wherein the rotating frame is capable of being rotated at least 30 degrees on the first axis in both a clockwise and counterclockwise direction from a flat position while the patient is lying on the bed wherein the rotating frame is configured to be capable, while the patient is supported by the tilting frame, of being rotated from a flat position while the patent is lying on the bed position to a position at least 30 degrees on the first axis in a clockwise direction and to a position at least 30 degrees in a counterclockwise direction from the flat position;

wherein the rotating frame is configured to be capable of being rotated at least 30 degrees on the first axis in both a clockwise direction and a counterclockwise direction from a flat position, while at least a portion of the patient is on the tilting frame;

wherein the tilting frame is configured to be capable of being tilted on the second axis by at least 60 degrees while supporting the patient;

wherein when the lower leg plate is positioned within and parallel to the tilting frame, the lower leg plate extends from a toe-end area of the tilting frame to a middle area of the tilting frame; and wherein the lower leg plate is configured as capable of being translated rotationally, both upward and downward from a horizontal position when the locking system is active, around the third axis.

2. The multi-positional bed of claim 1, wherein the rotating frame is configured as capable of being rotated 45 degrees on the first axis in both a clockwise and counterclockwise direction from the flat position while the patient is lying on the bed; and the tilting frame is configured as capable of being tilted on the second axis by 85 degrees while the patient is on the bed.

3. The multi-positional bed of claim 1, wherein the lower leg plate comprises a plurality of receptacles configured to accept one or more accessories.

4. The multi-positional bed of claim 1, wherein the lower leg plate is configured to be positioned above and substantially parallel to the tilting frame while turning arm is rotated upward, when the locking system is released.

5. The multi-positional bed of claim 1, further comprising:

a removable knee pad, configured to be attached to the bed while positioned between the patient's knees;

a first lower shield railing, rotatably supported by a right side of the rotating frame;

a second lower shield railing, rotatably supported by a left side of the rotating frame;

a first upper shield railing, rotatably supported by the first lower shield railing; and a second upper shield railing, rotatably supported by the first lower shield railing;

wherein each of the first and second lower shield railings is configured to be fixed in at least a first position approximately parallel to the rotating frame, and a second position rotated upward and approximately perpendicular to the rotating frame; and wherein each of the first and second upper shield railings is configured to be fixed in at least a third position downward from and substantially perpendicular to its respective lower shield railing, a fourth position substantially parallel to its respective lower shield railing, and a fifth position oriented in toward to rotating frame.

6. The multi-positional bed of claim 5, further comprising:

a hinge plate coupled to a first side of the first lower shield railing;

a hinge, configured to rotatably couple the hinge plate to the first upper shield railing;

a step attached to a second side of the first lower shield railing; and a pin configured to controllably move in each side of the first upper shield railing; and a movable handle coupled to the pin, configured to manually actuate movement of the pin, wherein, absent movement of the handle, an abutment of the pin against the step prevents the first upper shield railing from rotating out of the fifth position, and wherein a movement of the handle moves the pin away from the step.

7. The multi-positional bed of claim 5, further comprising: a movable safety lever configured to selectively secure the first upper shield railing in the fifth position.

8. The multi-positional bed of claim 1, wherein the foot-end leg includes a first wheel on a left side of the foot-end leg and a second wheel on a right side of the foot-end leg, wherein the first wheel and the second wheel each have an axis of rotation approximately perpendicular to the first axis; and the foot-end leg further includes a third wheel, having an axis of rotation approximately parallel to the first axis, wherein the third wheel is configured as selectively movable between a raised and lowered position, wherein when the third wheel is in the lowered position the foot-end leg is supported by the third wheel and when the third wheel is in the raised position the foot-end leg is supported by the first wheel and second wheel.

9. The multi-positional bed of claim 1, further comprising:

a bridging support that connects the foot-end leg and the head-end leg, and is adjacent to the rotating frame;

a jack, pivotally coupled to the bridging support and configured to be rotatable from a horizontal position to a vertical position; and at least two receptacles configured to accept accessories;

wherein the jack is configured such that, in the vertical position, it prevents a patient from tipping off of the bed while being transferred in or out of the bed using a portable patient lift attached to the bed.

10. The multi-positional bed of claim 1, further comprising:

a torso frame, wherein the torso frame is supported by the tilting frame and is configured to support the patient's upper body while the patient is lying on the bed;

wherein when the torso frame and the tilting frame are both in horizontal positions, and the torso plate extends from a head-end area of the tilting frame to a head-end area of the rotating frame; and wherein the torso plate is configured as capable of translating rotationally about a fourth axis parallel to the second axis and near the head-end area of the tilting frame.

11. The multi-positional bed of claim 10, further comprising:

a first motor, configured to selectively translate the lower leg plate rotationally;

a second motor, configured to selectively translate the torso plate rotationally; and a controller configured to operate the first motor and second motor at a first speed while in a program mode, and further configured to operate the first motor and second motor at a second speed greater than the first speed in response to manual commands.

12. A multi-positional bed, comprising:

a foot-end leg at a first end of the bed;

a head-end leg at a second end of the bed opposite from the first end;

a rotating frame, supported at an upper portion of the foot-end leg and at an upper portion of the foot-end leg to be rotatable on a first axis extending between the upper portion of the foot-end leg and the upper portion of the head-end leg;

a tilting frame, supported by the rotating frame, and configured to be capable being tilted on a second axis perpendicular to the first axis, wherein the tilting frame is configured to support the patient's entire body;

wherein the foot-end leg and the head-end leg are configured to be capable of being telescoped while the patient is on the bed such that a height of the foot-end leg is lower than a height of the head-end leg, and a slope of the first axis is at least 15 degrees, and the height of the foot-end leg is greater than the height of the head-end leg, and the slope of the first axis is at least 15 degrees;

wherein the rotating frame is configured to be rotatable at least 30 degrees on the first axis in both a clockwise direction and counterclockwise direction from a flat position while the patient is lying on the bed;

wherein the tilting frame is configured to be capable of being tilted on the second axis by at least 60 degrees while the patient is on the bed;

a mattress configured to be positioned under the patient's hips while the patient is lying on the bed; and a portable seat configured to be positioned under the mattress while the patient is lying on the bed;

wherein the portable seat includes belt attachments configured to allow the patient, the mattress, and the portable seat to be transferred in and out of the bed by use of a portable patient lift attached to the bed while the patient is seated on the mattress.

13. A multi-positional bed for a patient, comprising:

a telescoping foot-end leg at a first end of the bed;

a telescoping head-end leg at a second end of the bed opposite from the first end;

a rotating frame, configured as rotatable on a lateral first axis extending between an upper portion of the foot-end leg and an upper portion of the head-end leg;

a tilting frame, supported by the rotating frame, configured to tilt on a second axis perpendicular to the first axis, and further configured to support the patient's entire body while the patient is lying on the bed; and a torso plate, supported by the tilting frame and configured to support the patient's upper body while the patient is lying on the bed;

wherein the foot-end leg and the head-end leg are configured as capable of being telescoped while the patient is on the bed such that the height of the foot-end leg is lower than the height of the head-end leg and a slope of the first axis is at least 15 degrees, and such that the height of the foot-end leg is greater than the height of the head-end leg and a slope of the first axis is at least 15 degrees;

wherein the rotating frame is configured as capable of being rotated at least 30 degrees on the first axis in both a clockwise and counterclockwise direction from a flat position while the patient is lying on the bed;

wherein the tilting frame is configured as capable of being tilted on the second axis by at least 60 degrees while the patient is on the bed;

wherein when the torso plate is substantially parallel to the tilting frame, the torso plate extends from a head-end area of the tilting frame to a head-end area of the rotating frame; and wherein the torso plate is configured as capable of translating rotationally about a third axis parallel to the second axis and near the head-end area of the tilting frame.

14. The multi-positional bed of claim 13, further comprising:

a torso frame, supported by the tilting frame, configured to support the torso plate, and further configured to rotate upward around the third axis;

wherein the torso plate is configured to slide linearly along the torso frame away from the tilting frame while the torso frame is being rotated upwards.

15. The multi-positional bed of claim 14, wherein the torso frame is configured relative to the tilting frame such that the third axis is moved laterally toward the head end of the bed while the torso frame is being rotated upward.

16. The multi-positional bed of claim 14, wherein the torso frame is configured relative to the tilting frame such that the third axis is moved laterally while the torso plate is maintained substantially parallel to the tilting frame.

17. The multi-positional bed of claim 13, wherein the torso plate is further configured as translatable rotationally about a fourth axis parallel to the second axis and near the head-end area of the rotating frame.

* * * * *